US007152338B2

(12) United States Patent
Thompson et al.

(10) Patent No.: US 7,152,338 B2
(45) Date of Patent: Dec. 26, 2006

(54) TRUSS STABILIZER AND SPACING APPARATUS

(76) Inventors: Robert K. Thompson, 1497 Hard Scrapple Rd., Wellston, OH (US) 45692; Keith R. Thompson, 48 Hillcrest Dr., Victor, NY (US) 14564

( * ) Notice: Subject to any disclaimer, the term of this patent is extended or adjusted under 35 U.S.C. 154(b) by 1 day.

(21) Appl. No.: 11/069,417

(22) Filed: Mar. 1, 2005

(65) Prior Publication Data

US 2006/0196068 A1 Sep. 7, 2006

(51) Int. Cl.
*G01D 21/00* (2006.01)

(52) U.S. Cl. ..... 33/613

(58) Field of Classification Search ..... 33/613, 33/645

See application file for complete search history.

(56) References Cited

U.S. PATENT DOCUMENTS

| | | | | |
|---|---|---|---|---|
| 2,567,586 | A | 9/1951 | Werder | |
| 2,686,959 | A | 8/1954 | Robinson | |
| 3,201,874 | A | 8/1965 | Christy | |
| 3,959,945 | A | 6/1976 | Allen | |
| 4,322,064 | A | 3/1982 | Jarvis | |
| 4,420,921 | A | 12/1983 | Hardin | |
| 4,490,956 | A | 1/1985 | Palacio | |
| 4,704,829 | A | 11/1987 | Baumker, Jr. | |
| D293,416 | S | 12/1987 | Krueger | |
| 4,843,726 | A | 7/1989 | Ward | |
| 4,878,323 | A | 11/1989 | Nelson | |
| D318,785 | S | 8/1991 | Dean | |
| 5,129,153 | A | 7/1992 | Burns, Sr. | |
| 5,163,233 | A | 11/1992 | Benson | |
| D340,856 | S | 11/1993 | McHugh | |
| D347,587 | S | 6/1994 | Michael, Jr. | |
| 5,509,207 | A * | 4/1996 | Harms | 33/613 |
| 5,606,837 | A | 3/1997 | Holizlander | |
| 5,628,119 | A * | 5/1997 | Bingham et al. | 33/613 |
| 5,884,411 | A | 3/1999 | Raber | |
| 5,884,448 | A | 3/1999 | Pellock | |
| 6,385,859 | B1 * | 5/2002 | Varney | 33/613 |
| 6,393,794 | B1 | 5/2002 | Pellock | |
| 6,418,695 | B1 | 7/2002 | Daudet et al. | |
| 6,935,041 | B1 * | 8/2005 | Orton | 33/613 |
| 2002/0092259 | A1 | 7/2002 | Crawford | |

FOREIGN PATENT DOCUMENTS

| | | |
|---|---|---|
| EP | 1213399 A2 | 6/2002 |
| EP | 1213399 A3 | 7/2003 |

* cited by examiner

*Primary Examiner*—Christopher W. Fulton
(74) *Attorney, Agent, or Firm*—Patent Technologies, LLC; Robert D. Gunderman, Jr.

(57) ABSTRACT

An apparatus for stabilizing and spacing a second truss to a first truss, wherein each of said first truss and said second truss comprises a top chord and a bottom chord, and wherein said apparatus comprises a frame for spanning the top chords of said trusses, a stop attached to said frame, and a latch attached to said frame.

26 Claims, 29 Drawing Sheets

TRUSS STABILIZER AND SPACING APPARATUS

BACKGROUND OF THE INVENTION

1. Field of the Invention

An apparatus for stabilizing and spacing prefabricated trusses during the construction of a building.

2. Description of the Prior Art

The prior art has disclosed various devices for spacing and aligning structural building members. Reference may be had, e.g., to United States Patent Application Publication 2002/0092259 A1 (Truss Spacer and Brace) that discloses an apparatus for spacing structural members and for permanently bracing said structural members.

U.S. Pat. No. 3,959,945 (Roof Truss Spacer) discloses a method and apparatus for spacing prefabricated trusses and other structural members.

U.S. Pat. No. 4,490,956 (Truss Spacer) discloses another truss spacer for rigidly interconnecting and maintaining spacing between adjacent trusses.

U.S. Pat. No. 5,129,153 (Structural Member Spacing Tool) discloses yet another spacing tool for positioning structural members a predetermined distance apart.

U.S. Pat. No. 5,606,837 (Brace System For Use With a Truss System) discloses a brace that provides lateral support to a series of upright truss units.

U.S. Pat. No. 5,884,411 (Truss Alignment Apparatus) discloses a building frame alignment apparatus that includes a T-shaped beam member and a leveling indicator.

U.S. Pat. No. 5,884,448 (Truss Spacer and Support, Method of Use, And Structures Made Therewith) discloses a truss spacer and support device for installation between the chords of adjacent trusses, the device being employed to accurately space and support trusses during construction of a structure, and to provide added support against in-service loads.

U.S. Pat. No. 4,878,323 (Truss Setting System) discloses a system of set wedges and lateral notches for prefabricated metal truss units.

U.S. Pat. No. 6,393,794 (Truss Brace and Truss Structure Made Therewith) describes a truss system that utilizes braces to retain the trusses in spaced relation.

In addition, U.S. Pat. No. 6,418,695 (Building Component Spacer Brace) discloses a spacer bar to set building components at predetermined intervals relative to each other.

The devices of the prior art are used primarily to ensure adequate and proper spacing of building elements such as prefabricated trusses. The devices of the prior art do not address the erection of a prefabricated truss, or the need to balance an erected truss in an upright and vertical position while a spacing device is used. Setting of a prefabricated truss involves erecting the prefabricated truss from a horizontal position to a vertical position, establishing proper spacing and leveling of the truss, and securing the truss to an adjacent truss that has been previously erected. This process is typically performed on a scaffold or other temporary support structure that is often times more than eight feet above the ground. To use many of the devices of the prior art, a truss is set to a vertical position, and must be balanced in that position until the truss is spaced properly. This procedure is often times difficult, requires more than one person, and is prone to accidents.

It is an object of the present invention to provide an apparatus that assists in the erection of a truss, stabilizes and spaces said truss while proper alignment is determined, and braces the truss to another previously erected truss.

It is another object of the present invention to provide a truss stabilizer and spacing apparatus that will assist with the process of setting trusses and therefore reduce the number of workers required to set the trusses.

It is another object of the present invention to provide a truss stabilizer and spacing apparatus that will automatically capture and secure a truss that has been erected to a vertical orientation.

It is another object of the present invention to provide a truss stabilizer and spacing apparatus that will stop the vertical erection of a truss at a predetermined and desired vertical orientation.

These and other objects of the invention will be apparent from the discussion appearing in the remainder of this specification.

BRIEF SUMMARY OF THE INVENTION

In accordance with one embodiment of this invention, there is provided an apparatus for stabilizing and spacing a second truss to a first truss, wherein each of said first truss and said second truss comprises a top chord and a bottom chord, and wherein said apparatus comprises a frame for spanning the top chords of said trusses, a stop attached to said frame, and a latch attached to said frame.

The apparatus described above is advantageous because it simplifies the etting of trusses, increases worker safety while setting trusses, reduces the number of workers and associated labor involved in the setting of trusses, provides a single tool for both the setting and the spacing of trusses, and may be left in place after the trusses have been set to further serve as a purlin.

BRIEF DESCRIPTION OF THE DRAWINGS

The invention will be described by reference to the following drawings, in which like numerals refer to like elements, and in which.

Figure 1:
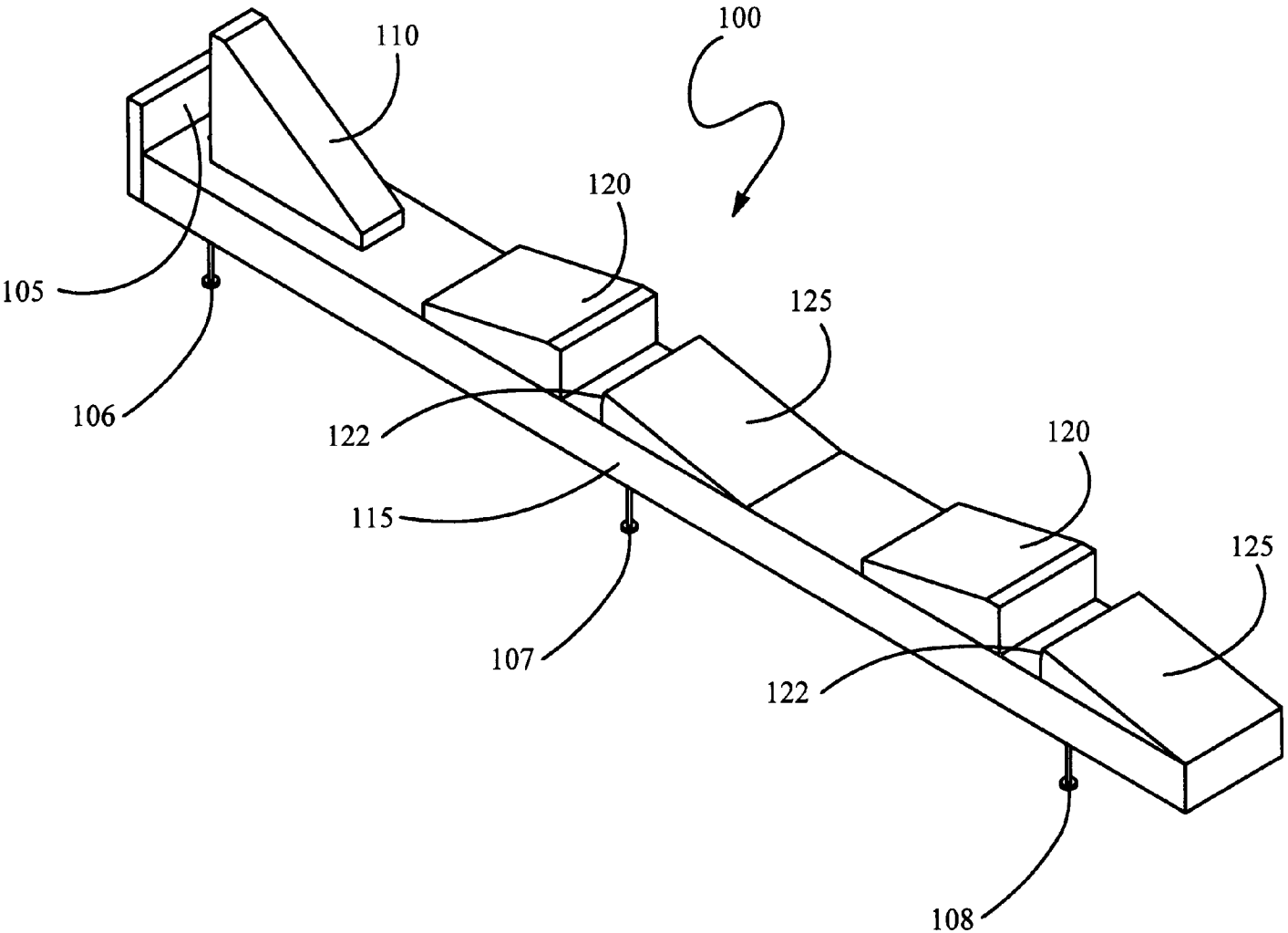
FIG. 1 is a perspective view of a starter captor.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DESCRIPTION OF THE PREFERRED EMBODIMENTS

For a general understanding of the present invention, reference is made to the drawings. In the drawings, like reference numerals have been used throughout to designate identical elements.

FIG. 1 is a perspective view of a starter captor 100. Referring to FIG. 1, the starter captor 100 serves to retain, stabilize and space trusses that are erected during construction of a building. Truss designs may include, but are not limited to, fink trusses, kingpost trusses, umbrella trusses, warren trusses, scissors trusses, monopitch trusses, rigid frame trusses, flat top trusses, cantilever trusses, gambrel trusses, howe trusses, single slope trusses, girder trusses, cambered fink trusses, arch frame trusses, raised bottom chord trusses, and the like. Trusses may be used in applications that include, but are not limited to, roof trusses, floor trusses, and the like. The present invention may be used for any form of truss, and may also, in some embodiments, be used to stabilize and space joists, or may, in other embodiments, be used to stabilize and space a combination of trusses and joists. In this specification, the term "set" may be used to describe the erection of a truss, as is commonly known and used by those skilled in the art. A starter captor frame 115 serves as the primary structural element of the starter captor 100, and may be made of wood, metal, a plastic such polypropylene, fiberglass, or the like. The starter captor frame 115 is an elongate, relatively rigid member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. Mounted to the starter captor frame 115 are, blocks and wedges that serve to capture and securely retain trusses as they are erected during construction of a building. Specifically, the end of the starter captor 100 is attached to the first truss to be erected during construction of a building, typically a gable end truss. A gable end truss is eventually covered with sheathing and siding material, and subsequently becomes exterior framing of the building. The starter captor is attached to a first truss, such as a gable end truss, by placing a top chord of the first truss between the mount end plate 105 and the mount support brace 110. The starter captor may also be attached to the first truss using a fastener 106 such as a nail, screw, lag bolt, or the like. The mount end plate 105 may be made of wood, metal, a plastic such polypropylene, fiberglass, or the like, and may be attached to the end of the starter captor 100 with fasteners such as nails, screws, rivets, bolts, glue and the like. In some embodiments, the mount end plate 105 may be an integral part of the starter captor frame 115. The support brace 110 may be made of wood, metal, a plastic such polypropylene, fiberglass, or the like, and may be attached to the starter captor frame 115 with fasteners such as nails, screws, rivets, bolts, glue, or the like. In some embodiments, the support brace 110 may be an integral part of the starter captor frame 115. The starter captor 100 also has at least one set of stop block 120 and wedge latch 125 pairs. A stop block 120 is a stop used to stop the swing of a truss that is being erected. A stop is a device to arrest or limit motion. A wedge latch 125 is a latch used to capture and retain a truss that is being erected. In FIG. 1, two such pairs are shown. The stop block 120 and the wedge latch 125 provide for capture, retention and spacing of trusses during construction of a building. The stop block 120 and the wedge latch 125 may be made of wood, metal, a plastic such as polypropylene, fiberglass, or the like, and may be attached to the starter captor frame 115 with fasteners such as nails, screws, rivets, bolts, glue, or the like. In some embodiments, the stop block 120 and the wedge latch 125 may an integral part of the starter captor frame 115. The spacing of the stop block 120 in relation to the wedge latch 125 is such that a truss may be securely retained between the stop block 120 and the wedge latch 125. The spacing of the stop block 120 in relation to the wedge latch 125 further allows for the alignment of said truss in a direction perpendicular to the side walls of a building. Often times trusses are manufactured from 2×4 kiln dried dimensional lumber such as Fir, Hemlock, or the like, and the spacing between the stop block 120 and the wedge latch 125 is slightly greater than 1.5 inches. As a second, third, and subsequent trusses are erected and retained by stop block 120 and wedge latch 125 pairs, the trusses may, in some embodiments, be secured to the starter captor 100 with a fastener 107 and a second fastener 108. The fastener 107 and the second fastener 108 may be nails, screws, rivets, bolts, or the like. In some embodiments, the wedge latch 125 may contain a bevel 122. The bevel allows a truss to more easily slide between the stop block 120 and the wedge latch 125 as the truss is being erected and retained by the starter captor 100. The spacing between the mount support brace 110 and a subsequent stop block 120 serves to define the specified spacing between trusses. Often times the trusses in a building are set at "two feet on center". This term refers to the distance between the center lines of two trusses. There are also situations where wider spacing, often times "four feet on center", is used in the construction of a building.

In use, once the starter captor 100 is attached to the first truss, as previously stated, a second truss is erected by swinging the second truss into a near vertical position and allowing a top chord of the second truss to slide along the inclined surface of the wedge latch 125 until the truss is captured and securely retained between the wedge latch 125 and the stop block 120. The second truss may, in some embodiments, be further secured with a fastener 107. Once a truss is erected, it becomes a support structure for the captor. The captor may, in some embodiments, be a starter captor. The captor may, in other embodiments, be a running captor. Once erected, the second truss further provides support for said starter captor 100. A third truss is also erected, captured, and securely retained using a similar technique, whereas the third truss is erected by swinging the third truss into a near vertical position and allowing a top chord of the third truss to slide along the inclined surface of the wedge latch 125 until the third truss is captured and securely retained between a wedge latch 125 and a stop block 120. The third truss may, in some embodiments, be further secured with a fastener 108.

Figure 2:
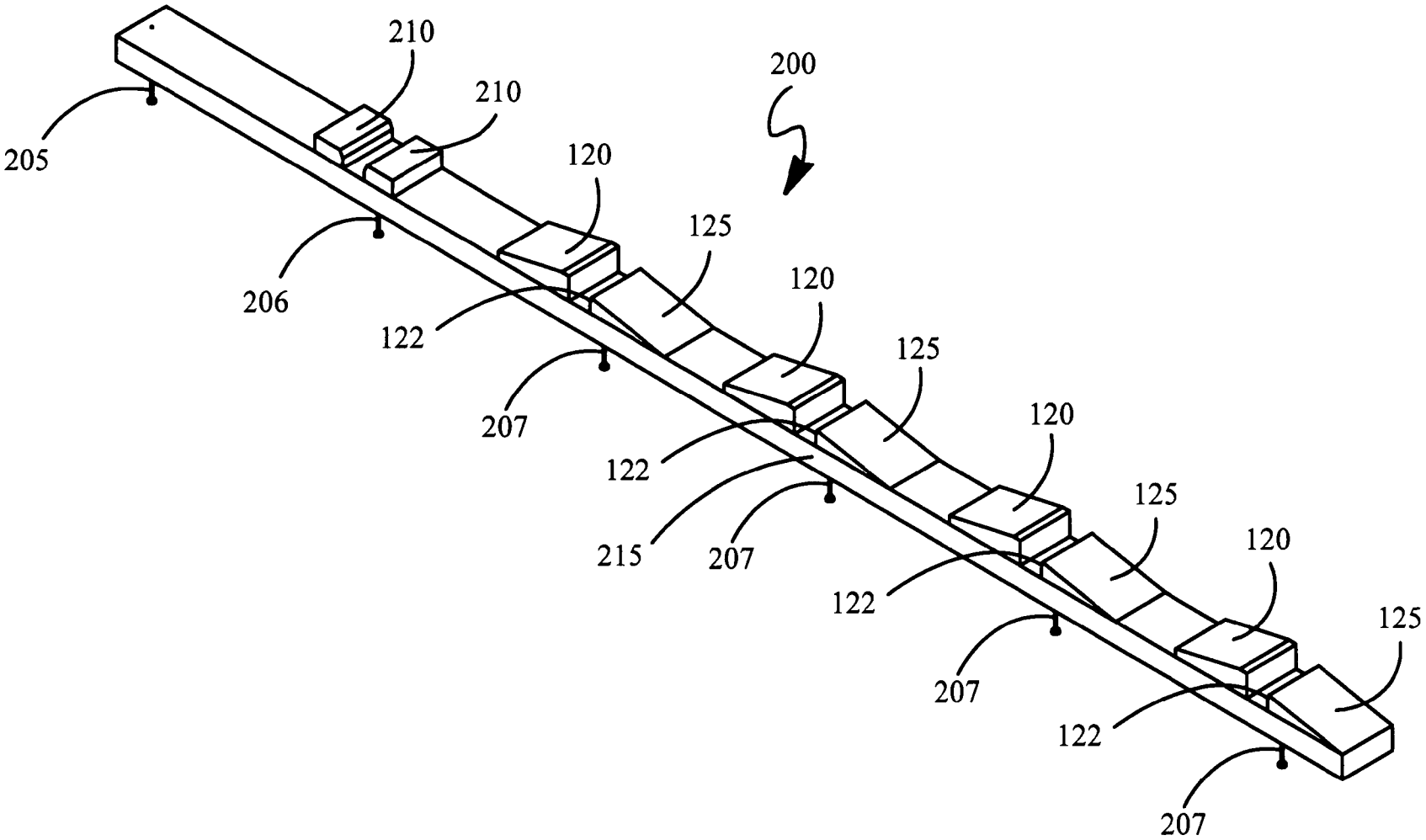
FIG. 2 is a perspective view of a running captor.

Referring now to FIG. 2, a perspective view of a running captor 200 is shown. Once trusses in the construction of a building have been set, spaced and retained with a starter captor 100, the running captor 200 allows for the continued setting of subsequent trusses. A running captor frame 215 serves as the primary structural element of the running captor 200, and may be made of wood, metal, a plastic such polypropylene, fiberglass, or a similar somewhat rigid material. The running captor frame 215 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. Mounted to the running captor frame are blocks and wedges that serve to capture and securely retain trusses as they are erected during construction of a building. In use, the running captor attaches to two fully erected and braced trusses (not shown). The first fully erected and braced truss (not shown) is attached to the running captor 200 with a fastener 205 such as a nail, a screw, a bolt, a rivet, a clamp, or the like. The second fully erected and braced truss (not shown) is attached to the running captor 200 by placing the second fully erected and braced truss between two mount blocks 210, and, in some embodiments, fastening the second fully erected and braced truss to the running captor 200 with a fastener 206 such as a nail, a screw, a bolt, a rivet, a clamp, or the like. The mount blocks 210 may be made of wood, metal, a plastic such polypropylene, fiberglass, or the like, and may be attached to the running captor frame 215 with fasteners such as nails, screws, rivets, bolts, glue, or the like. In some embodiments, the mount blocks 210 may an integral part of the running captor frame 215. Once the running captor 200 is firmly attached to two fully erected and braced trusses, subsequent trusses can be erected, captured and braced by swinging the subsequent truss into a near vertical position and allowing a top chord of the subsequent truss to slide along the inclined surface of the wedge latch 125 until the subsequent truss is captured and securely retained between the wedge latch 125 and the stop block 120. The subsequent truss may, in some embodiments, be further secured with a fastener 207. Once a truss is stabilized, it can be considered part of the support for running captor 200.

The starter captor 115 and the running captor 215 provide proper spacing to the top chords of trusses that are being erected during the construction of a building. Proper spacing of the bottom chords of these trusses is accomplished by using a base plate 300, as is shown in perspective view in FIG. 3. A primary structural element of the base plate 300 is the base plate frame 315. The base plate frame 315 may be made of wood, metal, a plastic such as polypropylene, fiberglass, or the like. Attached to the base plate frame 315 are a plurality of hinge blocks 330. The hinge blocks 330 provide for proper spacing of the bottom chords of a series of trusses. The hinge blocks may be made of wood, metal, a plastic such as polypropylene, fiberglass, or the like, and may be attached to the base plate frame 315 with fasteners such as nails, screws, rivets, bolts, glue, or the like. In some embodiments, the hinge blocks 330 may be an integral part of the base plate frame 315. In some embodiments, the base plate 300 may be fastened to a top plate of a load bearing side wall of a building using a fastener such nails, screws, bolts, rivets, glue and the like. In some embodiments, the hinge blocks 330 may also serve as wind anchorage points for the erected trusses, and may, in some embodiments, contain a fastener such as a nail, a screw, a bolt, a rivet, or the like.

FIGS. 4, 5, 6, 7, 8 and 9 show the use of a starter captor, a running captor and a base plate during the erection of a set of trusses. FIGS. 4, 5, 6, 7, 8 and 9 further show the time progression of a truss setting operation, and the use of the various components of the present invention to assist in a truss setting operation.

Figure 4:
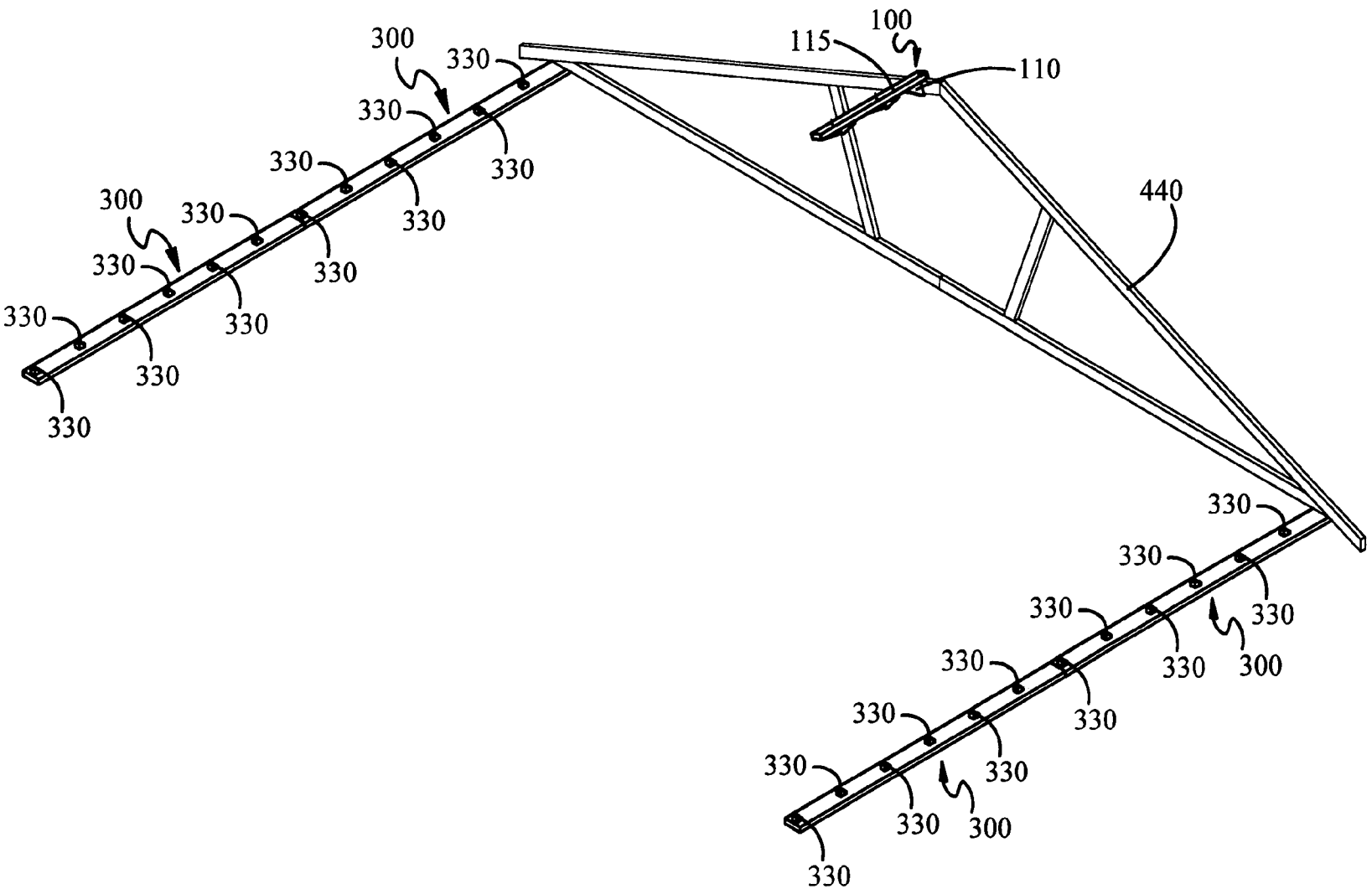
FIG. 4 is a perspective view of a starter captor and two base plates in use with a gable end truss.

Referring now to FIG. 4, several base plates 300 are placed end to end, and attached to the top plate of a load bearing side wall of a building (not shown). In some embodiments, the base plates are attached to the top plate of a load bearing side wall of a building using fasteners such nails, screws, bolts, rivets, glue and the like. A first truss such as the gable end truss 440 shown in FIG. 4 is erected to a vertical position, braced leveled and secured as is known to those skilled in the art. A starter captor 100 is then attached to a top chord of the gable end truss 440 using techniques previously described, and, in some embodiments, fastened to the top chord of the gable end truss 440 with a fastener such as a nail, a screw, a bolt, a rivet, or the like.

Figure 5:
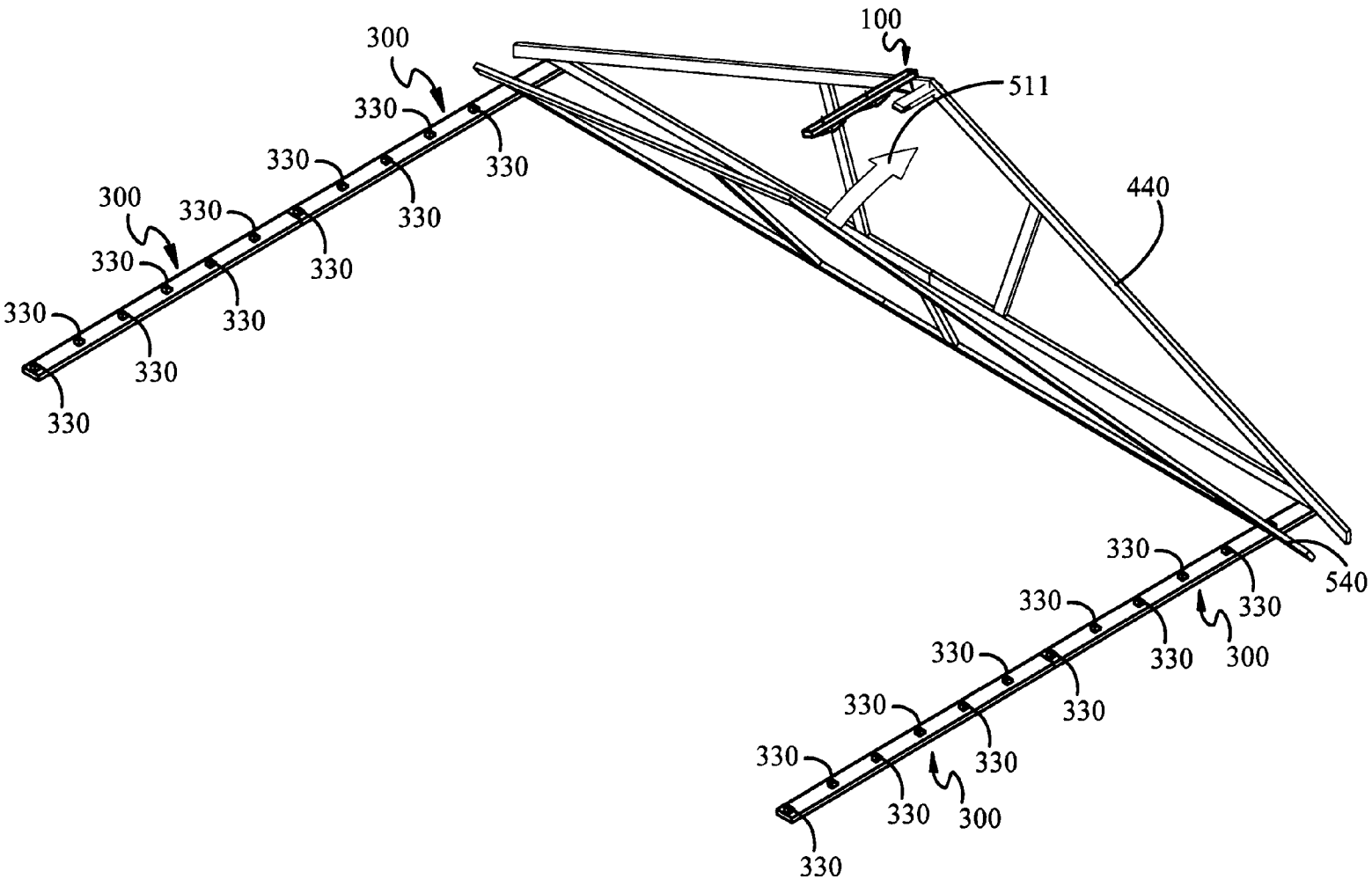
FIG. 5 is a perspective view of a starter captor and two base plates in use with a gable end truss in place and a second truss being erected.
Figure 6:
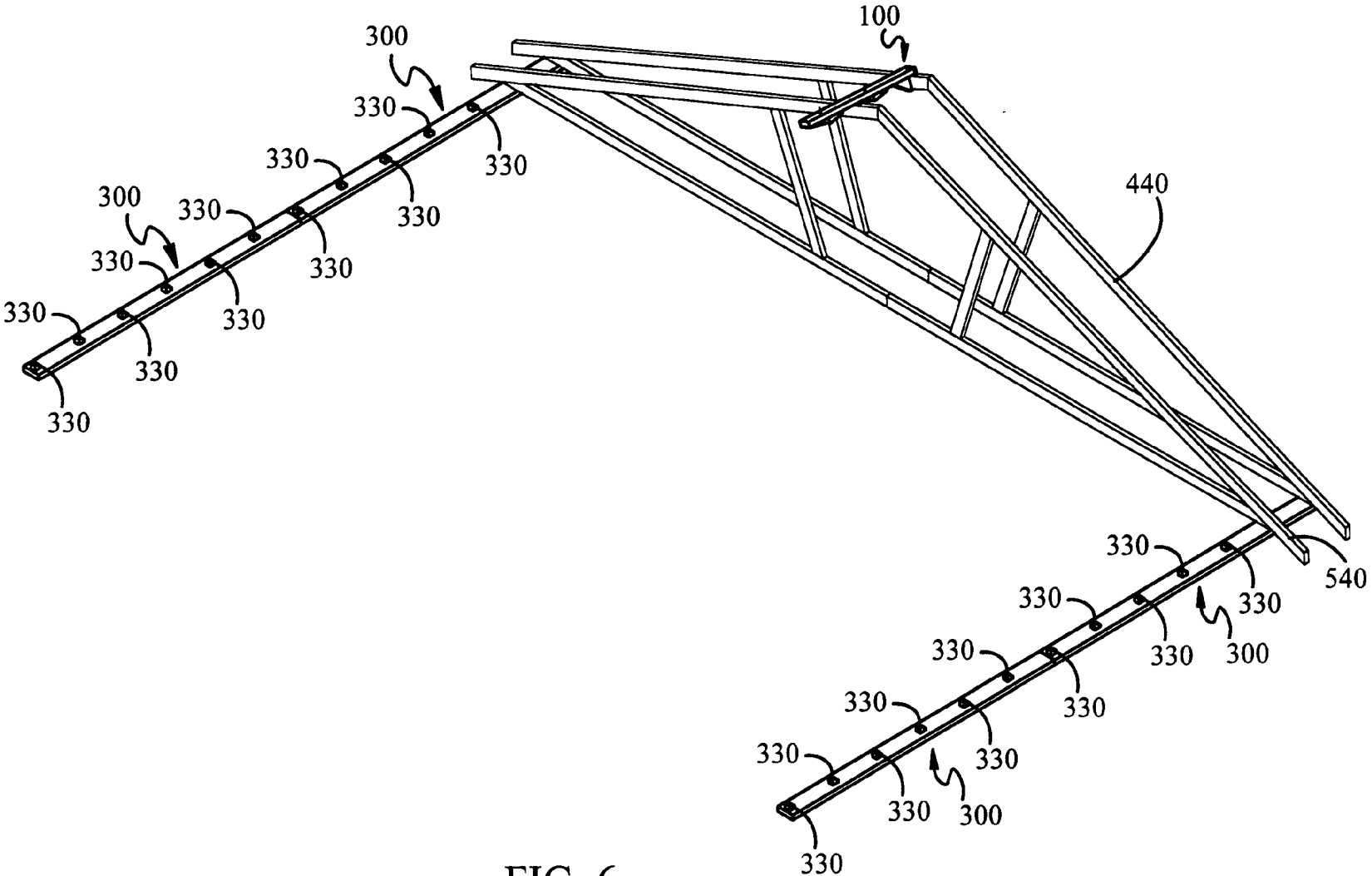
FIG. 6 is a perspective view of a starter captor and two base plates in use with a gable end truss in place and a second truss being positioned.
Figure 7:
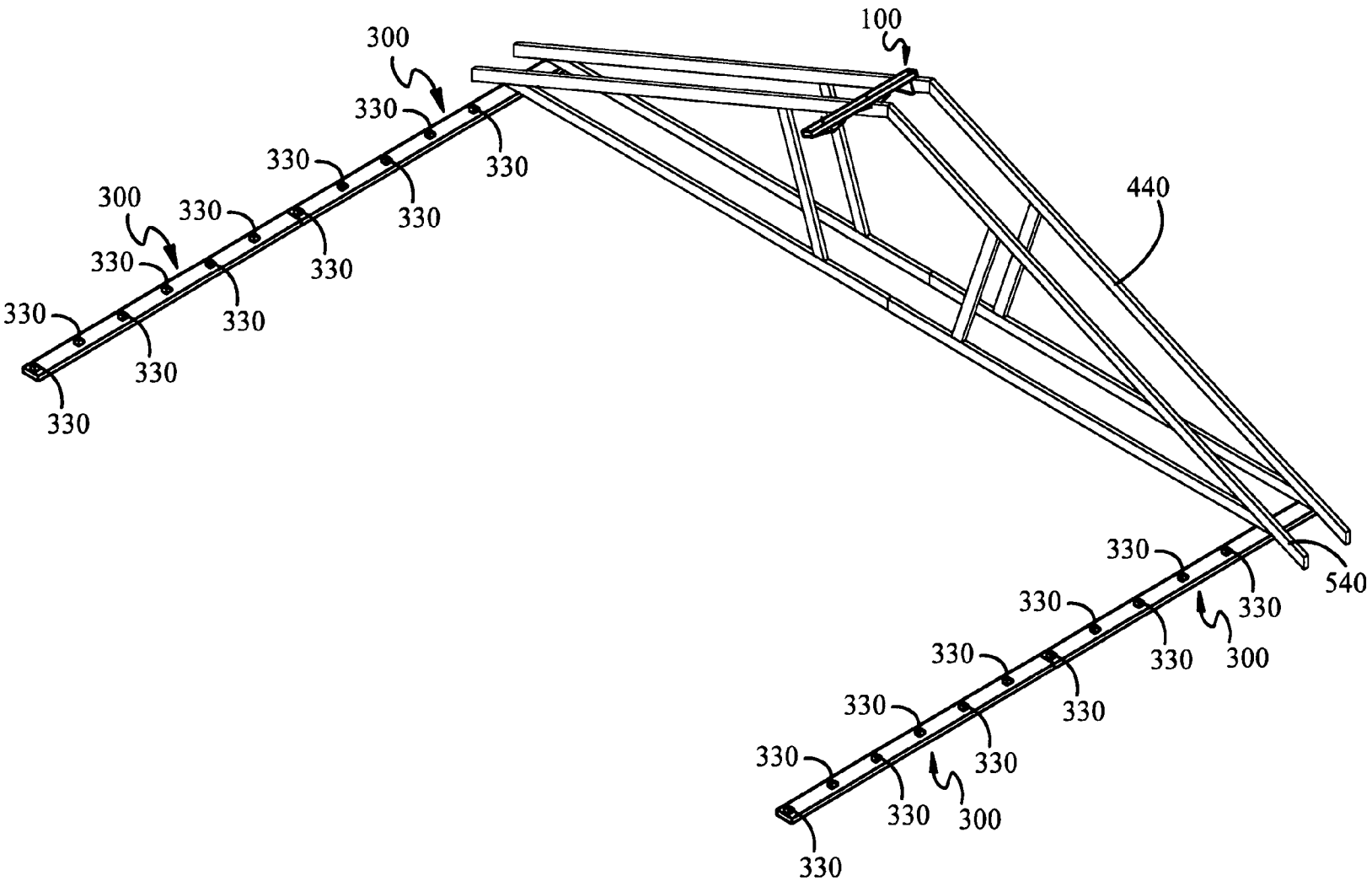
FIG. 7 is a perspective view of a starter captor and two base plates in use with a gable end truss and a second truss in place.

Referring now to FIG. 5, a second truss 540 is placed across two load bearing side walls (not shown) such that the bottom chord of the second truss 540 is resting on base plates 300 that are attached to the top plate of both load bearing side walls. The bottom chord of the second truss 540 is placed behind the hinge block that is closest to the gable end truss 440 on both load bearing side walls. The second truss 540 is now erected (set). The direction arrow 511 indicates the direction that the second truss 540 travels as it is set. As the second truss 540 reaches a vertical position, the starter captor 100 will capture, retain and brace the top chord of the second truss 540, as is shown in FIG. 6. FIG. 7 now shows the second truss 540 in it's final position, captured and retained by the starter captor 100. The second truss 540 may, in some embodiments, be fastened to the starter captor 100 with nails, screws, bolts, clamps, rivets, or the like. Once the second truss is stabilized, it further provides support for starter captor 100. The use of the hinge blocks 330 and the starter captor 100 provide not only a safe labor saving apparatus for erecting a truss, but also provide for the proper spacing and subsequent alignment of adjacent trusses during the construction of a building.

Figure 8:
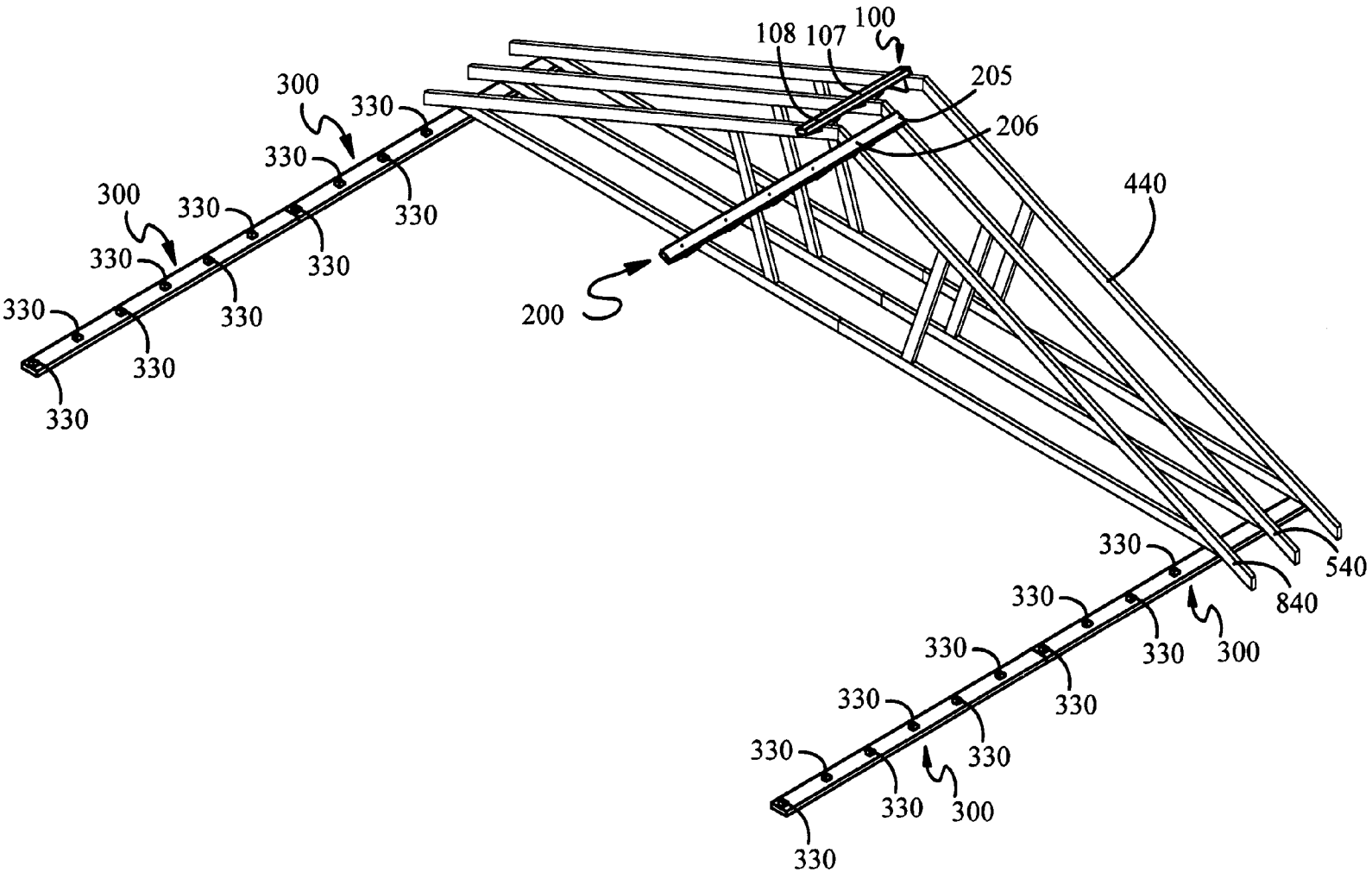
FIG. 8 is a perspective view of a starter captor, two base plates, and a running captor in use with a gable end truss, a second truss, and a third truss in place.

Referring now to FIG. 8, the use of a running captor 200 to allow for the continuation of the truss setting process is shown. FIG. 8 again shows base plates 300 attached to the top plate of a load bearing side wall, with several erected trusses in their final position. The gable end truss 440, a second truss 540, and a third truss 840 are shown in their final position, and are being retained by a starter captor 100. To continue setting subsequent trusses, a running captor 200 is attached to the second truss 540 and the third truss 840 using fasteners 205 and 206. The second truss 540 and the third truss 840 are, in some embodiments, further retained to the running captor 200 by the use of mount blocks 210.

Figure 9:
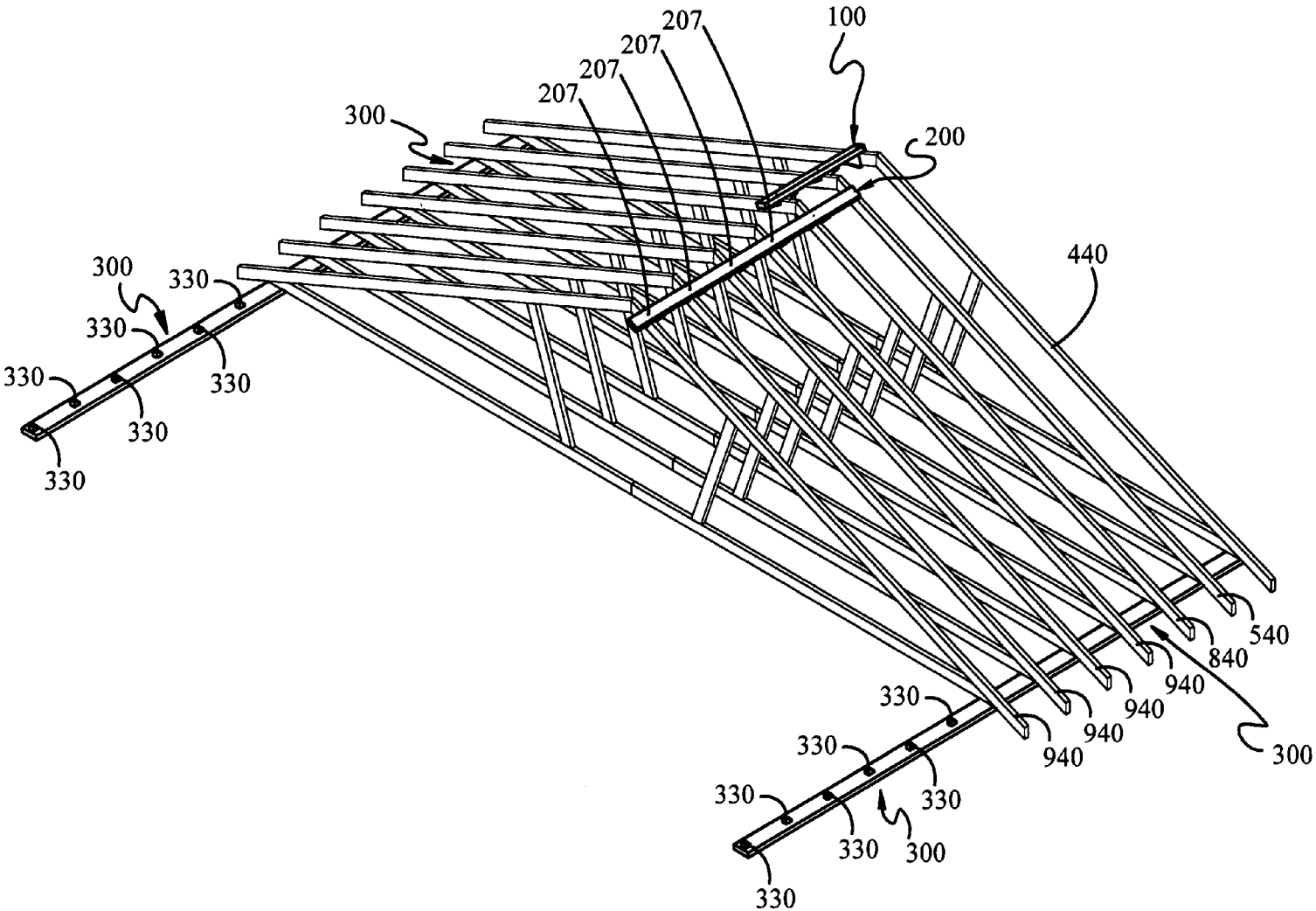
FIG. 9 is a perspective view of a starter captor, two base plates, and a running captor in use with numerous trusses in place.

Referring now to FIG. 9, subsequent trusses 940 are erected using the hinge blocks 330. The subsequent trusses 940 are then captured, retained and braced by the running captor 200. In some embodiments, the top chord of the subsequent truss 940 is fastened to the running captor 200 with a fastener 207. The assembly and setting of trusses continues, with additional running captors 200 being used as required. As each truss is stabilized, it becomes part of the support for running captor 200. The quantity of running captors 200 and also the quantity of base plates 300 that are used in the construction of a building will vary based on the overall length of the building under construction. Often times, one skilled in the art will set both gable end trusses prior to setting the remaining trusses. Other times, the trusses are set sequentially. The gable end trusses may also be sheathed in plywood, siding, or the like prior to erection. Other embodiments of this invention will address the various construction techniques that may be used while setting trusses. These various construction techniques are often times regional, or may be a matter of personal preference. Often times, local building codes dictate the choice of construction techniques.

Figure 10:
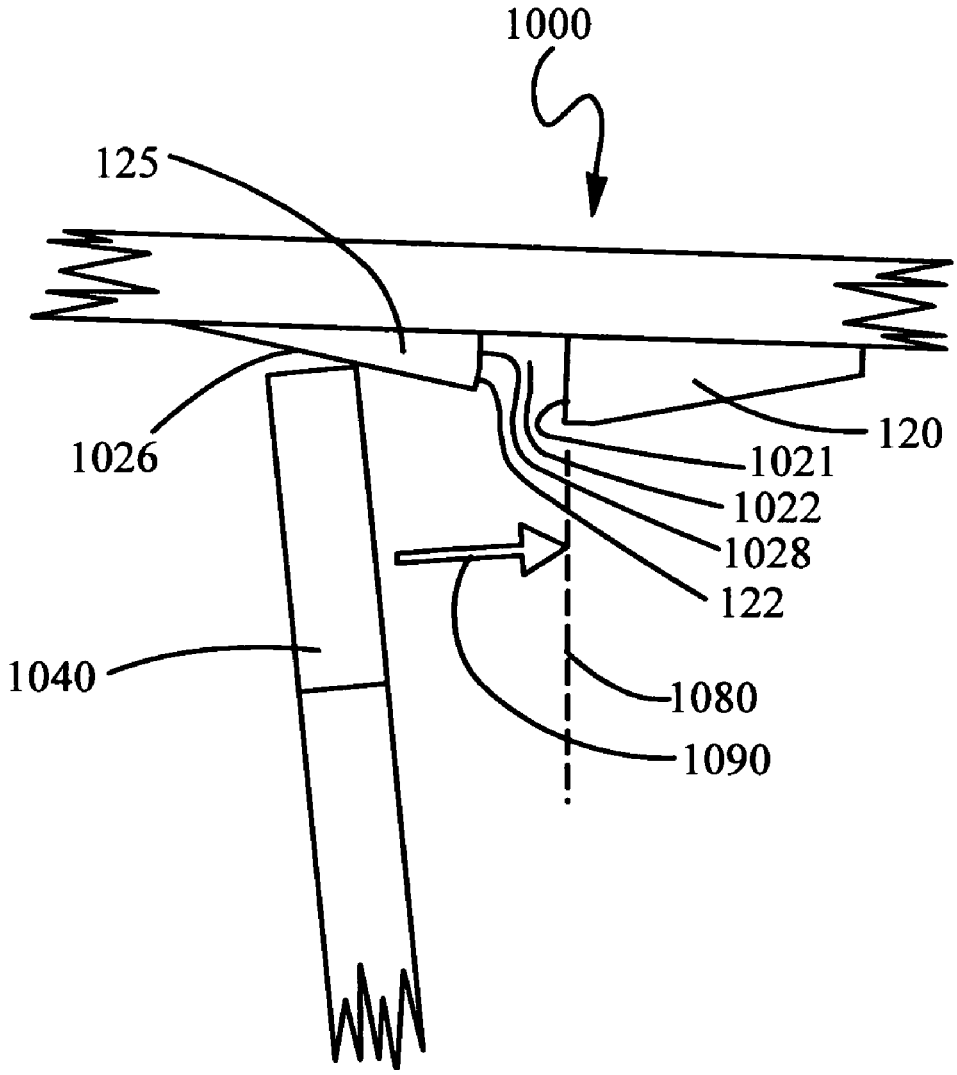
FIG. 10 illustrates the use of a captor to secure and retain a truss.
Figure 11:
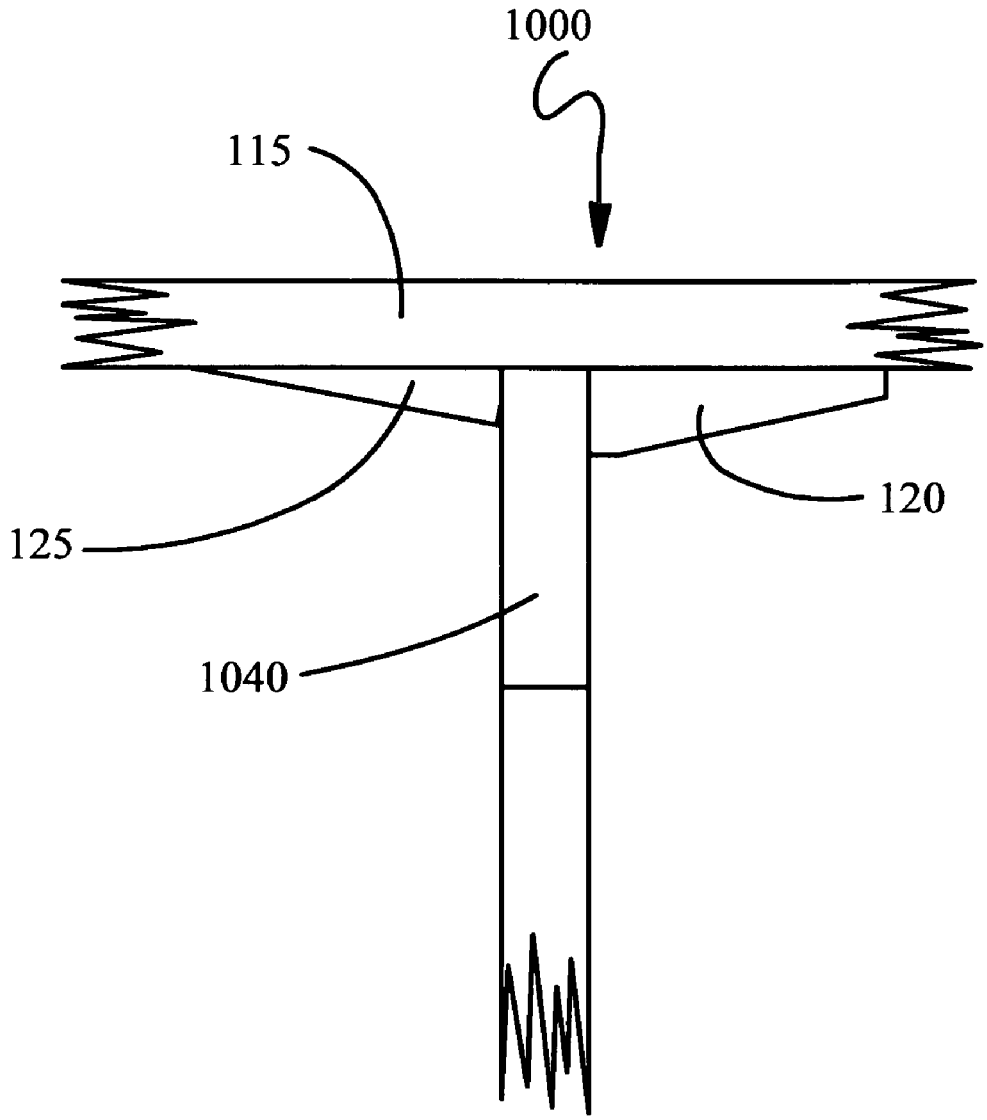
FIG. 11 illustrates a captor securing a truss.

Referring now to FIGS. 10 and 11, the use of a starter captor 100 and a running captor 200, and more specifically the use of a stop block 120 and a wedge latch 125 that are components of both a starter captor 100 and a running captor 200, are clearly shown. Referring first to FIG. 10, the process of stabilizing a truss by capturing and retaining the truss is shown by way of example. In FIG. 10, a cutaway section of a truss 1040 is shown in the process of being captured by a captor segment 1000. The captor segment 1000 may be a cutaway segment of either a starter captor 100 or a running captor 200. The truss 1040 illustrated in FIG. 10 may also be any truss, other than the first, used in the construction of a building. The truss 1040 is erected, and follows the direction arrow 1090 as the truss 1040 approaches it's final position. As the truss 1040 contacts the wedge latch 125, and more specifically, the sliding plane 1026 of the wedge latch 125, the captor segment 1000 will rise vertically. The captor segment 1000 will also provide downward pressure to the truss 1040 that will further assist with retaining the truss 1040. The wedge latch 125 may, in some embodiments, contain a bevel 122. As the truss 1040 continues to be erected, the slot 1022 will retain the truss 1040. The truss segment 1000 will travel downward, and the stop face 1021 will cause the travel of the truss 1040 to stop along the stop plane 1080. The orthogonal face 1028 will prevent the truss 1040 from traveling backwards. The slot 1022 may, in some embodiments, be slightly larger than the width of the top chord of a truss to provide for unencumbered truss capture and retention, as well as accommodating irregularly dimensioned lumber, lumber that has increased in size due to moisture, and the like. In some embodiments, the slot 1022 may contain springs, pads, bushings, or other items that may assist in providing a secure fit for the top chord of the truss 1040. In other embodiments, the slot 1022 may vary in width. FIG. 11 now shows the truss 1040 securely held in position between the stop block 120 and the wedge latch 125. The truss 1040 may further be aligned in a direction perpendicular to the side walls of a building.

Figure 12:
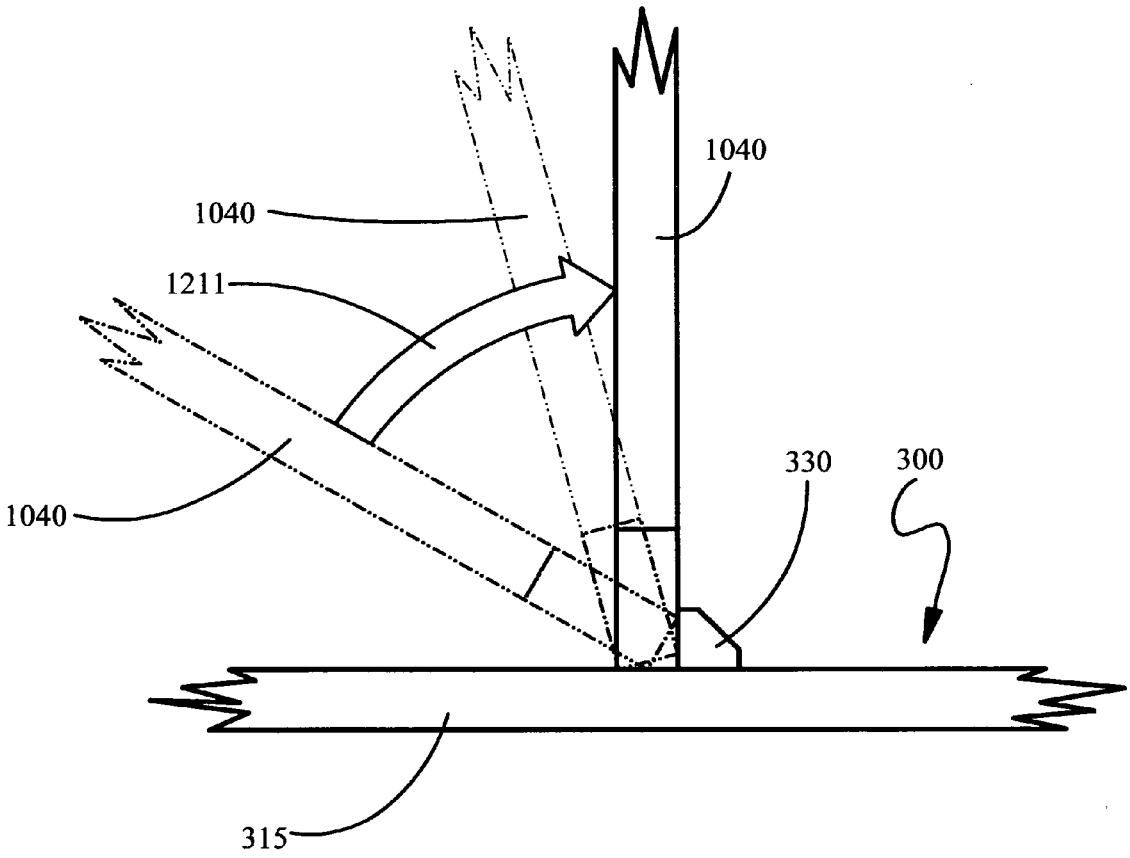
FIG. 12 illustrates the use of a hinge block to assist with the erection of a truss.

Referring now to FIG. 12, the use of a hinge block 330 to assist with the erection of a truss is shown. Hinge blocks 330 are mounted to a base plate frame 315, as is shown in the perspective view of a base plate 300 in FIG. 3. The base plate 300 is often times attached to the top plate of a load bearing side wall. The bottom chord of a truss 1040 is stopped by the hinge block 330, and the truss 1040 is set into position as indicated by the direction of swing arrow 1211.

Figure 13:
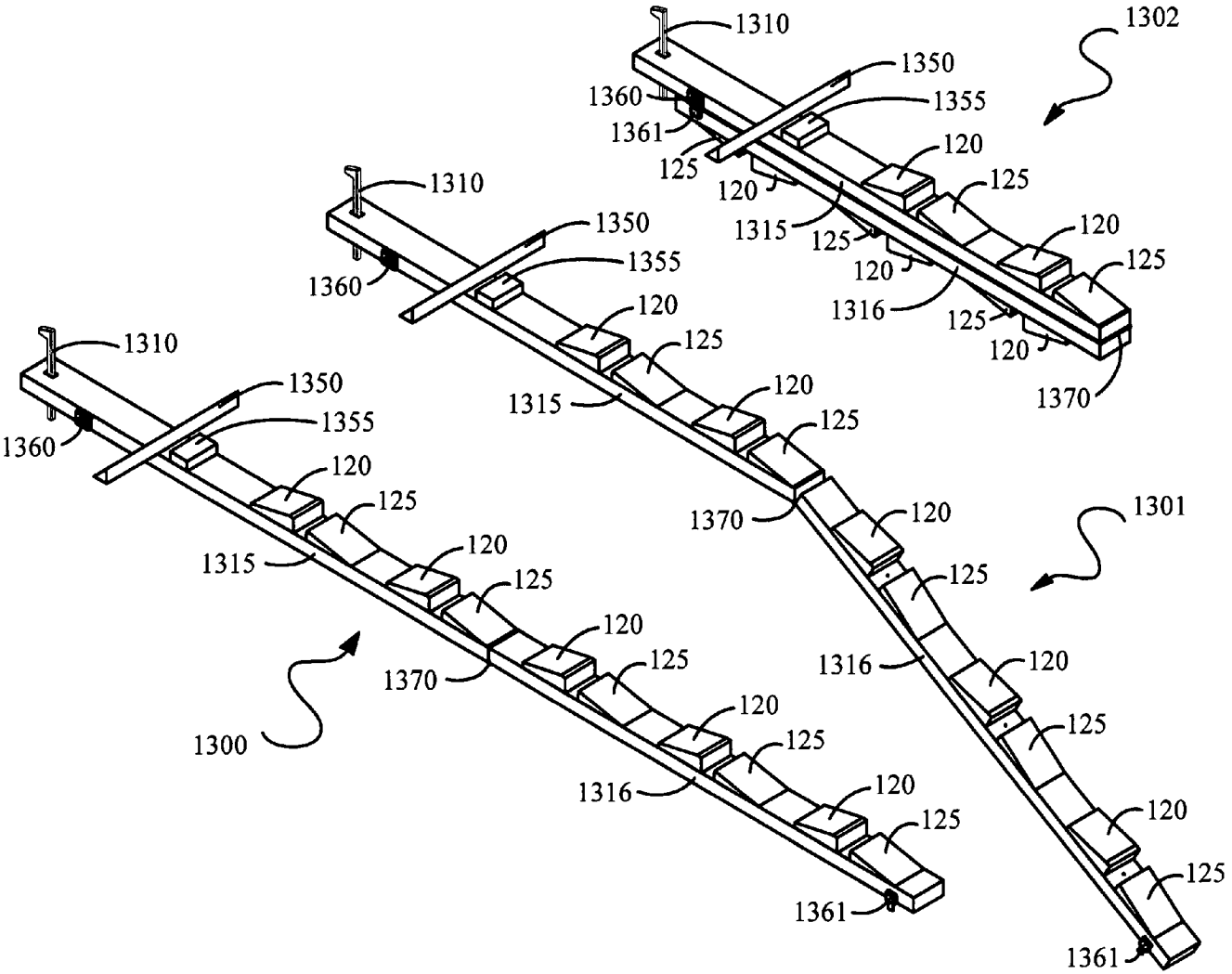
FIG. 13 is a time variant view of a folding running captor showing the folding running captor in an open position, a partially folded position, and a folded position.

Referring now to FIG. 13, a folding running captor is illustrated in three different positions. 1300 is a folding running captor in a fully extended position. 1301 is a folding running captor in a partially folded position, and 1302 is a folding running captor in a fully folded position. A folding running captor allows for the easy storage and transportation of a running captor. A first half of a folding captor frame 1315 and a second half of a folding captor frame 1316 are connected with a folding frame hinge 1370. A latch pin 1360 and a latch socket 1361 are used in some embodiments to secure the folding running captor in a fully folded position 1302. In some embodiments, a mount hook 1310 may be used to secure the folding running captor 1300 to the top chord of a truss. A mount hook may be made of metal, plastic, wood, fiberglass, or the like. A squaring mount arm 1350, and in some embodiments, a squaring mount block 1355 may be used in some embodiments to ensure a perpendicular relationship of the folding running captor 1300 with the trusses. The squaring mount arm 1350 and the squaring mount block 1355 are examples of squaring mechanisms. A squaring mechanism is a device to orient a first component with a second component at approximately a right angle orientation. Various embodiments of squaring mechanisms will become evident to those skilled in the art.

The use of prefabricated trusses in the construction of buildings may at times require the use of purlins. A purlin, also known as a roof girt, is a structural building element that spans the top chords of multiple trusses, and is usually oriented perpendicular to the top chord of each truss. A purlin strengthens the overall roof truss structure, and also provides additional support for the roof. Often times purlins are used when truss spacing increases beyond a certain distance. Factors to be considered in the specification of purlins include truss spacing, roof sheathing and roof load, snow load, wind loading, truss design and sizing, and the like. Purlin requirements are often times specified by a structural engineer.

Figure 14:
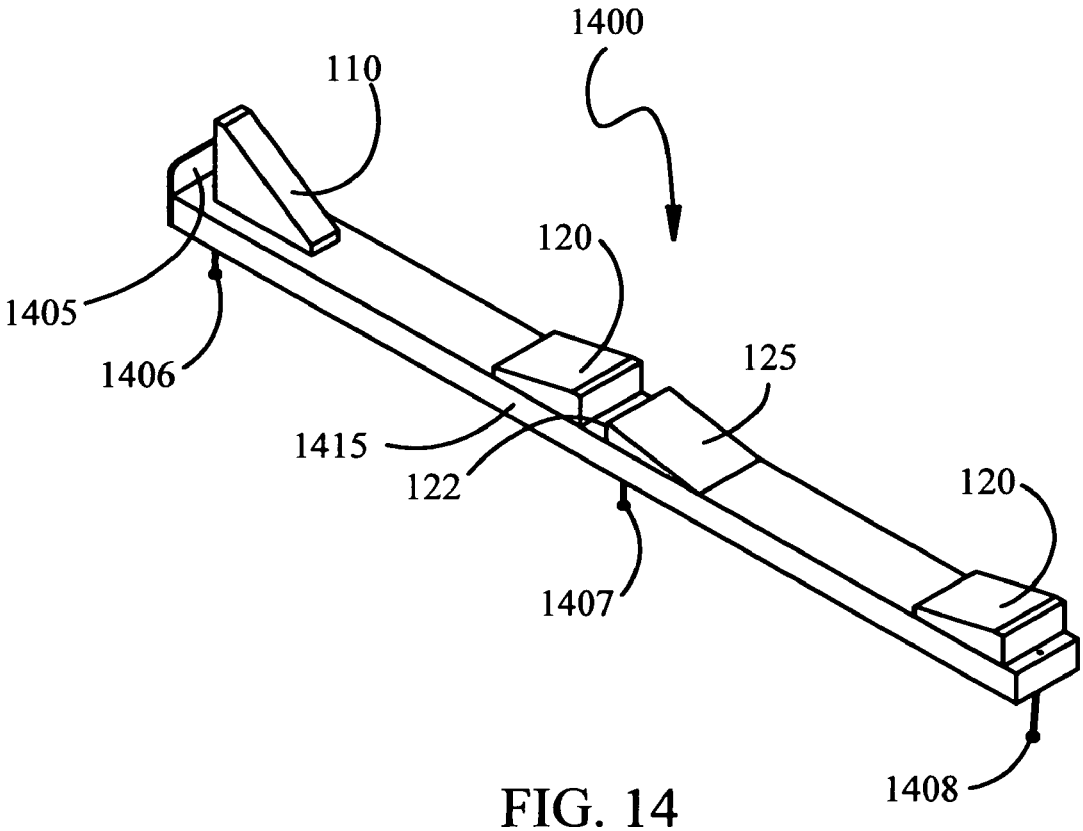
FIG. 14 is a perspective view of a purlin starter captor.

In some embodiments of the present invention, a starter captor and a running captor may be left in place after the trusses are erected. This may be done for convenience, or the starter captor and the running captor may be used as purlins. FIG. 14 depicts a purlin starter captor 1400. A purlin starter captor frame 1415 serves as the primary structural element of the purlin starter captor 1400, and may be made of wood, metal, a plastic such polypropylene, fiberglass, or the like. The purlin starter captor frame 1415 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The purlin starter captor 1400 contains a mount end plate 1405 and a mount support brace 110 that allows the purlin starter captor 1400 to be attached to the top chord of a first truss such as a gable end truss. The mount end plate 1405 is thin and strong, preferably less than ¼ inch thick. The mount end plate 1405 is preferably manufactured from steel. The mount end plate 1405 may be driven between wall sheathing and the top chord of a first truss such as a gable end truss that has already been covered with a wall sheathing, for example, plywood. The purlin starter captor 1400 may be further fastened to a first truss such as a gable end truss using a fastener 1406 such as a nail, a screw, a bolt, a rivet, or the like. The purlin starter captor 1415 also has at least one set of stop block 120 and wedge latch 125 pairs. In FIG. 14, one pair is shown. The stop block 120 and the wedge latch 125 provide for capture, retention and spacing of trusses. The stop block 120 and the wedge latch 125 may be made of wood, metal, a plastic such as polypropylene, fiberglass, or the like, and may be attached to the purlin starter captor frame 1415 with fasteners such as nails, screws, rivets, bolts, glue, or the like. In some embodiments, the stop block 120 and the wedge latch 125 may be an integral part of the purlin starter captor frame 1415. The spacing of the stop block 120 in relation to the wedge latch 125 is such that a truss may be securely retained between the stop block 120 and the wedge latch 125. For example, often times trusses are manufactured from 2×4 kiln dried dimensional lumber such as Fir, Hemlock, or the like, and in such an example the spacing between the stop block 120 and the wedge latch 125 is slightly greater than 1.5 inches. Once a truss top chord is placed in the space between the stop block 120 and the wedge latch 125, a second fastener 1407 may be used to further secure the purlin starter captor 1400 to a truss. The wedge latch 125 may, in some embodiments, contain a bevel 122. The purlin running captor 1400 also contains a stop block 120 without a wedge latch 125. The stop block 120 is, in some embodiments, offset from the end of the purlin running captor by one half of the thickness of the top chord of a truss. For example, trusses that contain dimensional lumber with a thickness of 1½ inches would require an offset of ¾ inch. This offset allows for the placement and subsequent attachment of a purlin running captor 1500 on the same truss at which the purlin starter captor 1400 terminates. The purlin starter captor may, in some embodiments, be further fastened to a truss with a third fastener 1408.

Figure 15:
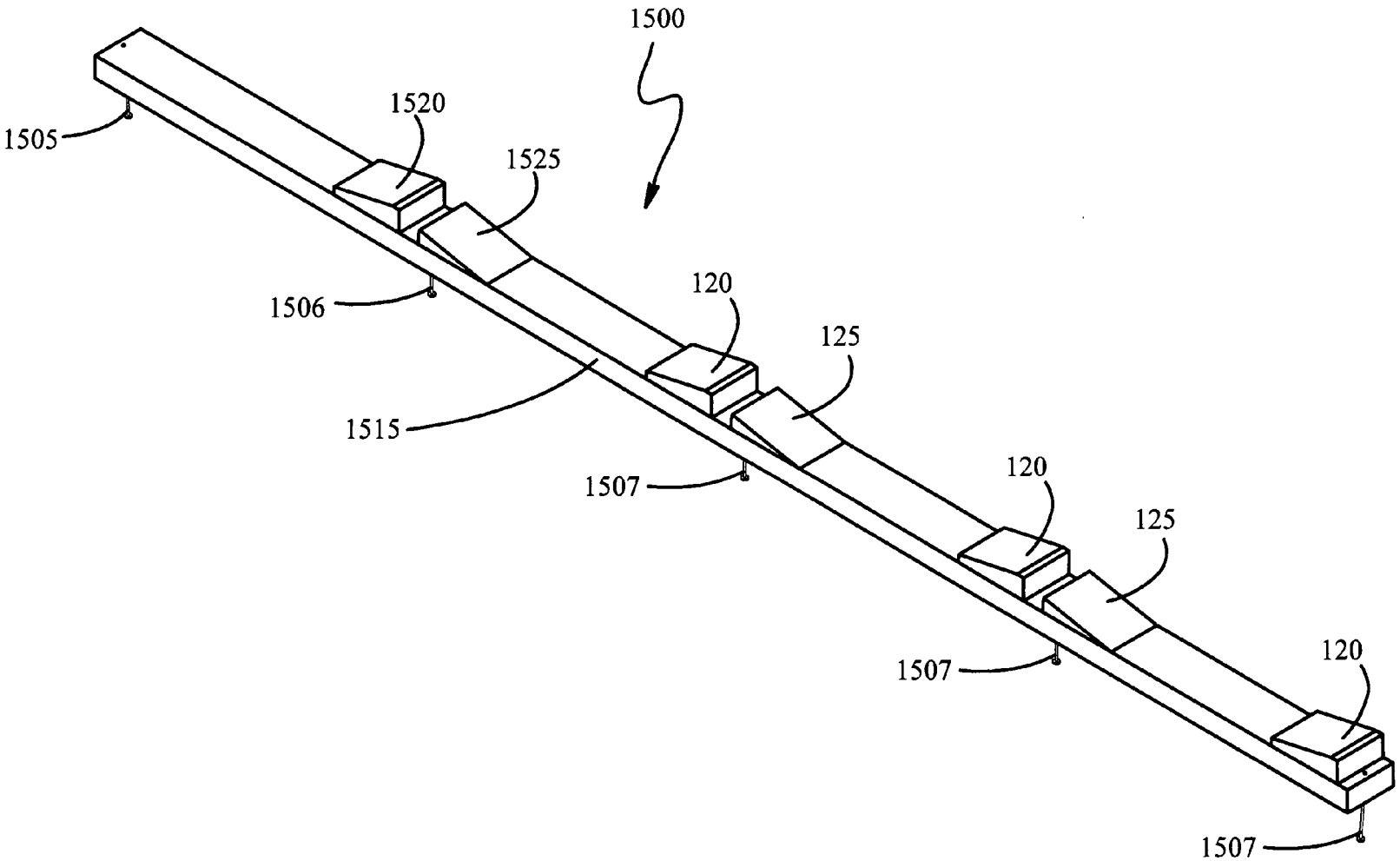
FIG. 15 is a perspective view of a purlin running captor

Referring now to FIG. 15, a purlin running captor 1500 is shown. A purlin running captor 1500 is designed to be kept in place after trusses are erected, and serve as a purlin. Once the first several trusses in the construction of a building have been set, spaced and retained with a purlin starter captor 1400, the purlin running captor 1500 allows for the continued setting of subsequent trusses. A purlin running captor frame 1515 serves as the primary structural element of the purlin running captor 1500, and may be made of wood, metal, a plastic such polypropylene, fiberglass, or the like. The purlin running captor frame 1515 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. Mounted to the purlin running captor frame 1515 are various braces, blocks and wedges that serve to capture and securely retain trusses as they are erected during construction of a building. In use, the purlin running captor attaches to a fully erected and braced truss (not shown). Often times, these fully erected and braced trusses are being retained by a purlin starter captor 1400. The fully erected and braced trusses are attached to the purlin running captor 1500 with a first fastener 1505 such as nails, screws, bolts, rivets, clamps, or the like. A top chord of a subsequent truss is placed between mount block 1520 and mount wedge 1525. The purpose of mount block 1520 and mount wedge 1525 is to assist in the positioning of the purlin running captor. A second fastener 1506 such as a nail, a screw, a bolt, a rivet, a clamp, or the like may be used to further fasten the purlin running captor 1500 to a truss. The mount block 1520 and the mount wedge 1525 may be made of wood, metal, a plastic such polypropylene, fiberglass, or the like, and may be attached to the purlin running captor frame 1515 with fasteners such as nails, screws, rivets, bolts, glue, or the like. In some embodiments, the mount block 1520 and the mount wedge 1525 may an integral part of the starter captor frame 1515. The spacing of the mount block 1520 in relation to the mount wedge 1525 is such that a truss may be securely retained between the stop block 1520 and the wedge latch 1525. The top chords of subsequent trusses are placed between the wedge latch 125 and the stop block 120. The subsequent trusses may, in some embodiments, be further secured with a fastener 1507 such as a nail, a screw, a bolt, a rivet, a clamp, or the like.

Figure 16:
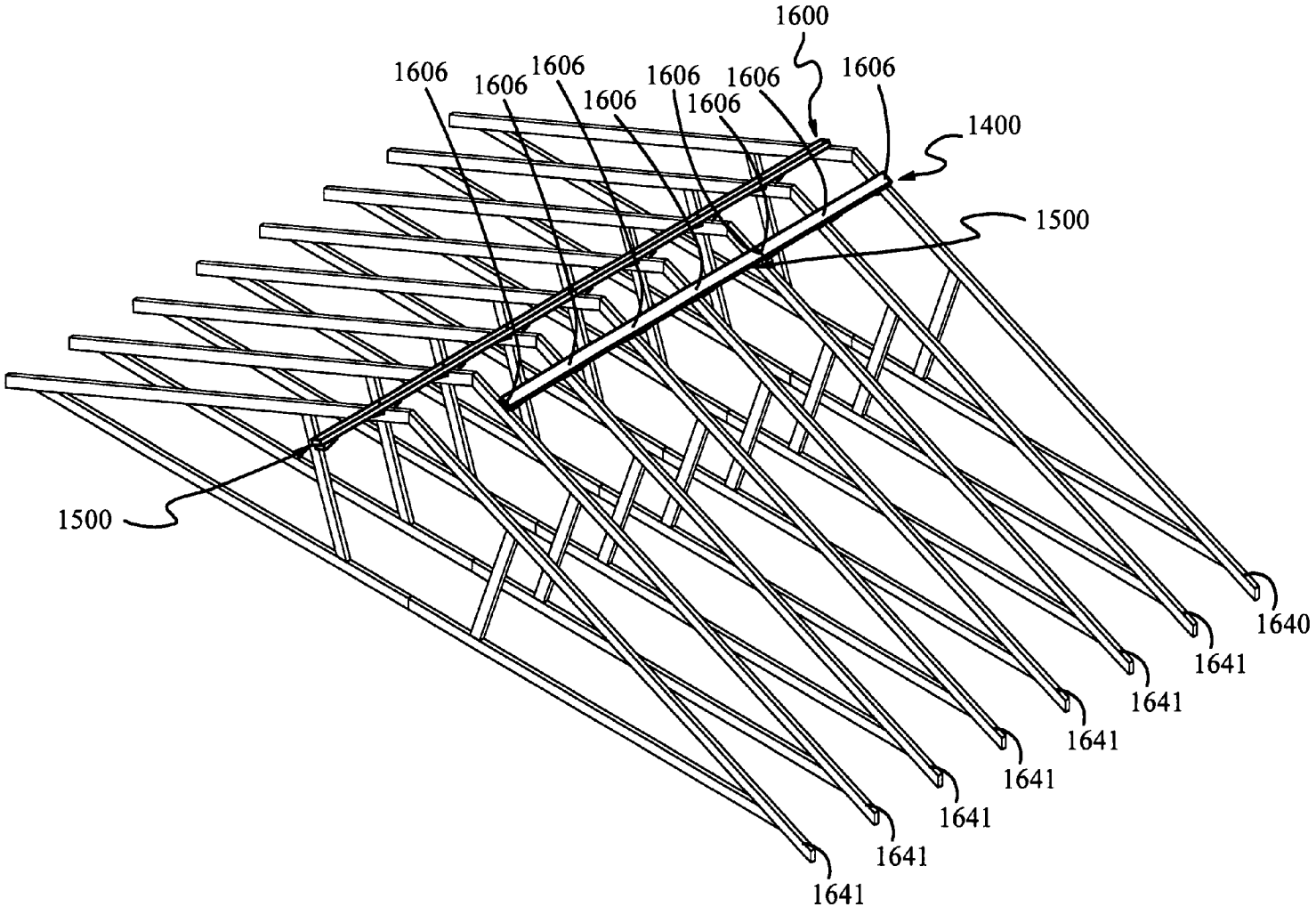
FIG. 16 is a perspective view of a purlin starter captor and a purling running captor installed on a plurality of trusses.

FIG. 16 is a perspective view of one purlin starter captor 1400 and three purlin running captors 1500 installed on a plurality of trusses. A completed run of a purlin starter captor 1400 and purlin running captors 1500 makes up a purlin 1600. FIG. 16 shows one gable end truss 1640 and seven trusses 1641. Not shown is the remainder of the building. In some embodiments, multiple purlins are used, and are often times run in parallel and spaced evenly apart. The spacing and quantity of purlins is often times determined through structural analysis, and the analysis is often times performed by a structural engineer.

Figure 17:
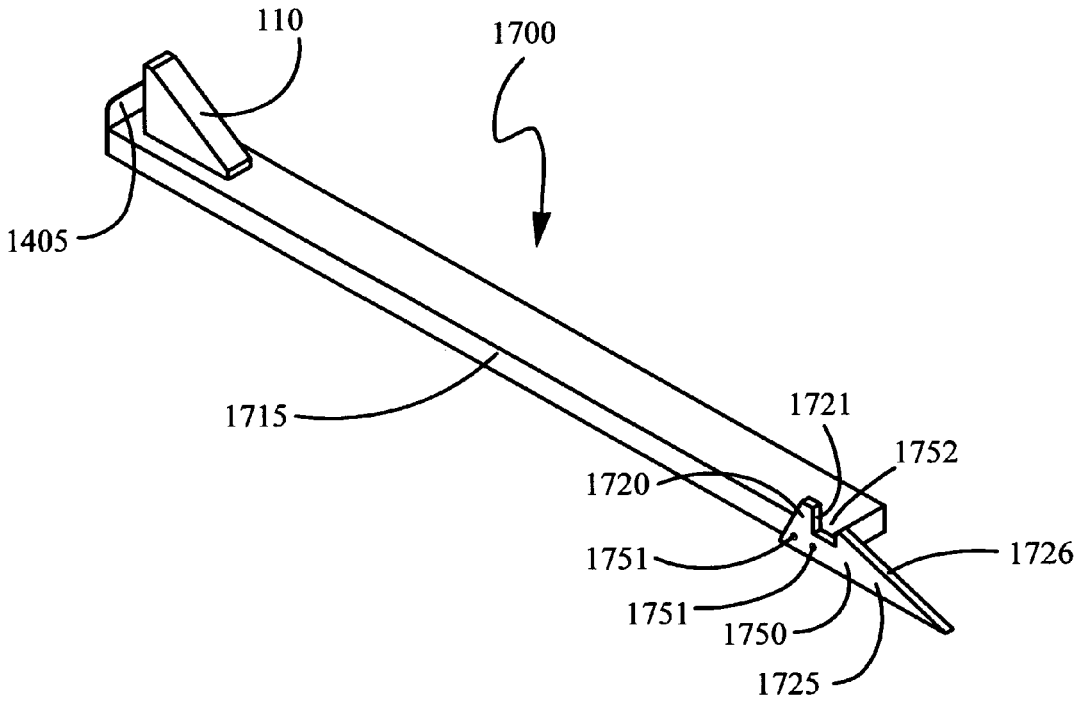
FIG. 17 is a perspective view of a starter captor for widely spaced trusses.

FIG. 17 is a perspective view of a starter captor for widely spaced trusses 1700. In certain circumstances, the design of a building may require that trusses be spaced widely apart. This spacing may be in excess two feet, and as a result, may require the use of a starter captor that has been adapted for such a specific situation. The starter captor for widely spaced trusses 1700 uses a mount end plate 1405 and a mount support brace 110 for attachment to the top chord of a first truss, such as a gable end truss. The use of a mount end plate 1405 allows for insertion of the mount end plate 1405 between wall sheathing and the top chord of the gable end truss. The mount support brace 110 provides additional support for the starter captor for widely spaced trusses 1700 to a gable end truss. The starter captor for widely spaced trusses frame 1715 serves as the primary structural element of the starter captor 100, and may be made of wood, metal, a plastic such polypropylene, fiberglass, or the like. The starter captor for widely spaced trusses frame 1715 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The mount end plate 1405 and the mount support brace 110 are attached to the starter captor for widely spaced trusses frame 1715 with fastening techniques that may include nailing, screwing, riveting, gluing, welding, bolting, and the like. The starter captor for widely spaced trusses 1700 further contains a silhouette stop block and wedge latch 1750. A silhouette form is the outline of a body viewed as circumscribing a mass. A silhouette form, as used to describe the silhouette stop block and wedge latch 1750, refers to the circumscribing of a truss by said silhouette stop block and wedge latch 1750. The silhouette stop block and wedge latch 1750 contains a stop block 1720 and a wedge latch 1725. A slot 1752 is formed between the stop block 1720 and the wedge latch 1725, and serves to capture and retain a top chord of a truss. The silhouette stop block and wedge latch 1750 may be made of metal, plastic, fiberglass, wood, plywood, or the like. The silhouette stop block and wedge latch 1750 is fastened to the starter captor frame 1715 with fastening techniques that may include nailing, screwing, riveting, gluing, welding, bolting, and the like. In use, as a truss is erected, it will contact the sliding surface 1726, and raise the starter captor for widely spaced trusses upward. As the truss continues to be erected, it will encounter the stop face 1721, and the truss will be captured and retained in the slot 1752. The starter captor for widely spaced trusses 1700 may, in some embodiments, remain in place, and, in some embodiments, may act as a purlin. The positioning of the silhouette stop block and wedge latch 1750 in relation to the starter captor frame 1715 allows the use and positioning of a running captor such as shown in FIGS. 2 and 15 at the end of the starter captor frame 1715.

Figure 18:
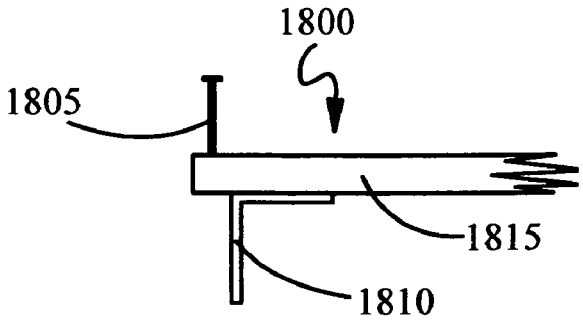
FIGS. 18, 19 and 20 illustrate various embodiments of starter captor hardware.
Figure 19:
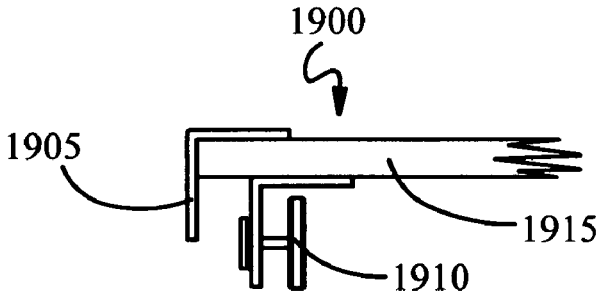
Figure 20:
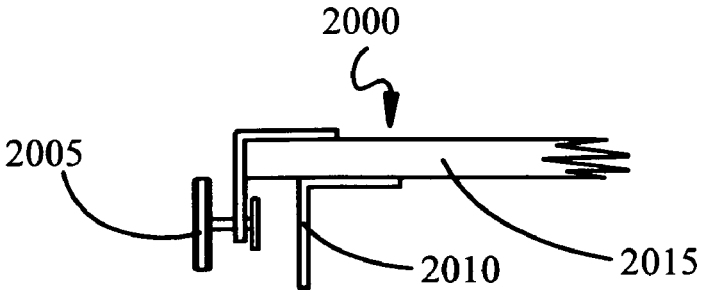

Referring now to FIGS. 18, 19 and 20, various mounts for starter captors are shown. A mount for a starter captor provides a means for attaching the starter captor to a first truss such as a gable end truss. In FIG. 18, a nail anchored starter captor 1800 is shown. A nail 1805 is used to attach the nail anchored starter captor 1800 to the top chord of a first truss such as a gable end truss. A captor frame 1815 may, in some embodiments, contain an inside brace 1810 to provide additional support for the nail anchored starter captor 1800. The brace 1810 may be made of metal, wood, plastic, fiberglass, or the like. FIG. 19 shows an inside clamp starter captor 1900. An inside clamp 1905 is used to attach the inside clamp starter captor 1900 to the top chord of a first truss such as a gable end truss. A captor frame 1915 may, in some embodiments, contain an outside brace 1905 to provide additional support for the inside clamp starter captor 1900. The outside brace 1905 may be made of metal, wood, plastic, fiberglass, or the like. FIG. 20 shows an outside clamp starter captor 2000. An outside clamp 2005 is used to attach the outside clamp starter captor 2000 to the top chord of a first truss such as a gable end truss. A captor frame 2015 may, in some embodiments, contain an inside brace 2010 to provide additional support for the outside clamp starter captor 2000. The inside brace 2010 may be made of metal, wood, plastic, fiberglass, or the like. Other clamps, hardware and techniques may be used to attach a starter captor to a truss, and these variations, alternatives and modifications will be apparent to those skilled in the art. These mounts may, in some embodiments, also be used on running captors.

Figure 3:
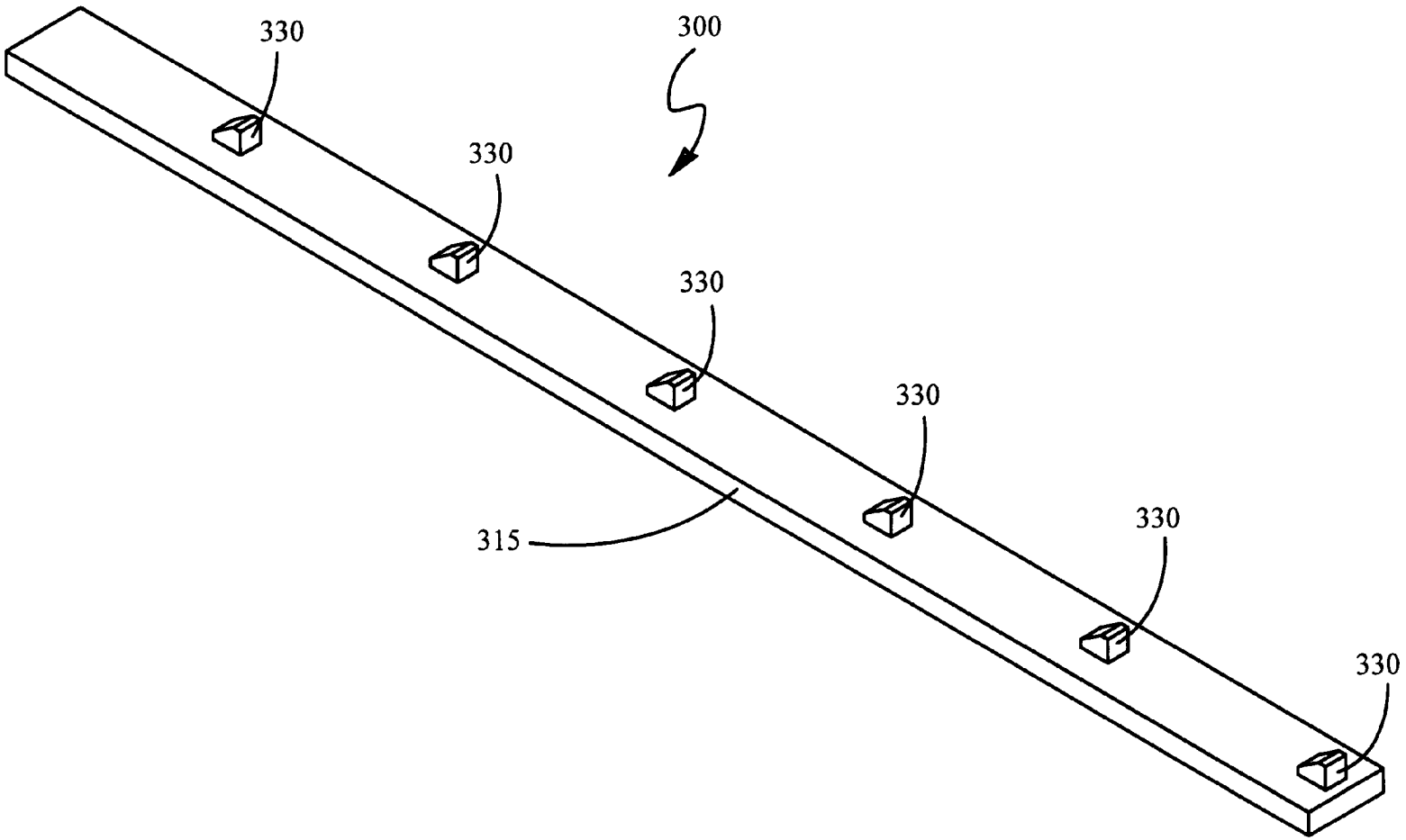
FIG. 3 is a perspective view of a base plate.
Figure 21:
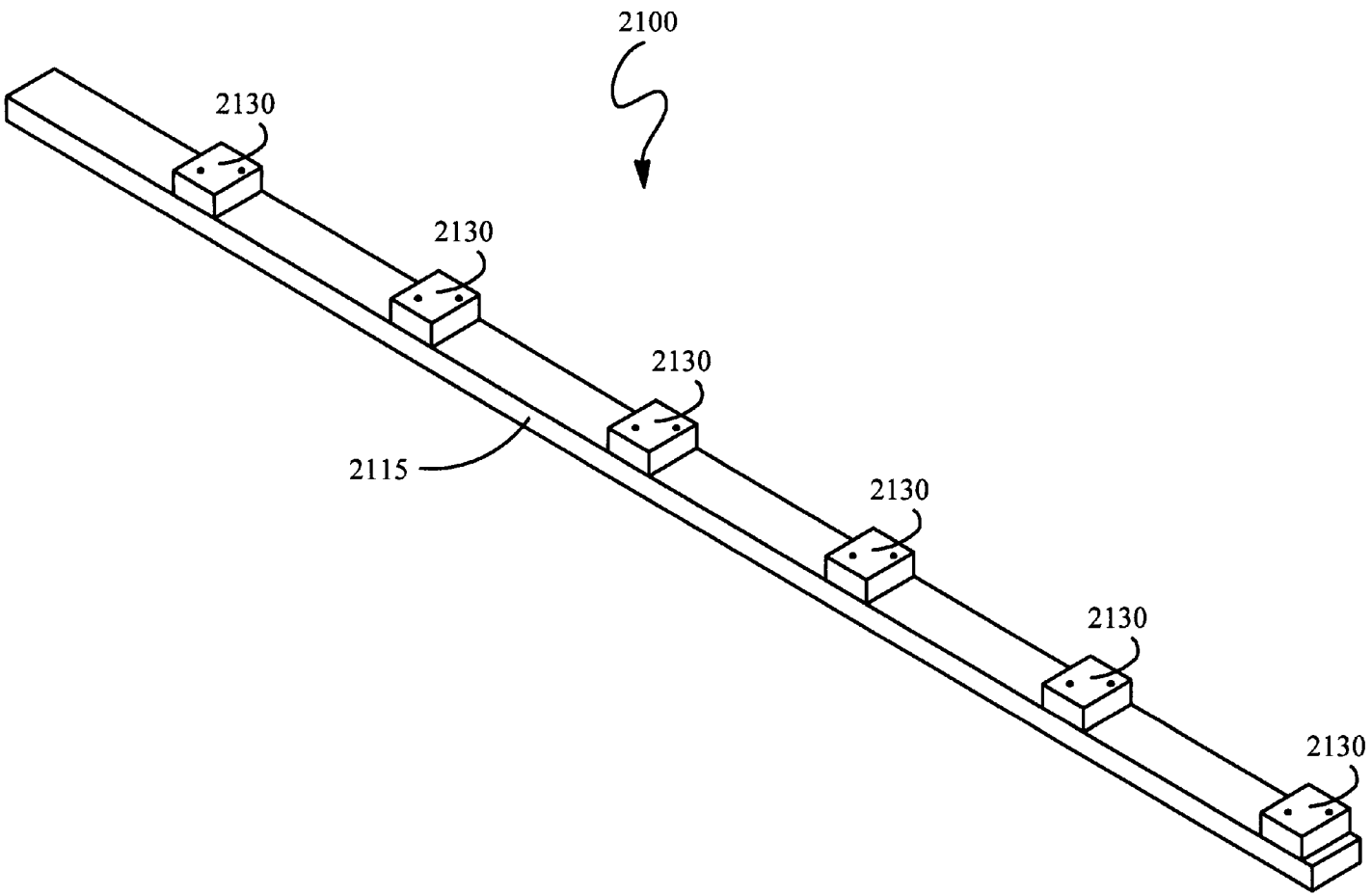
FIG. 21 is a perspective view of a wood block base plate.
Figure 22:
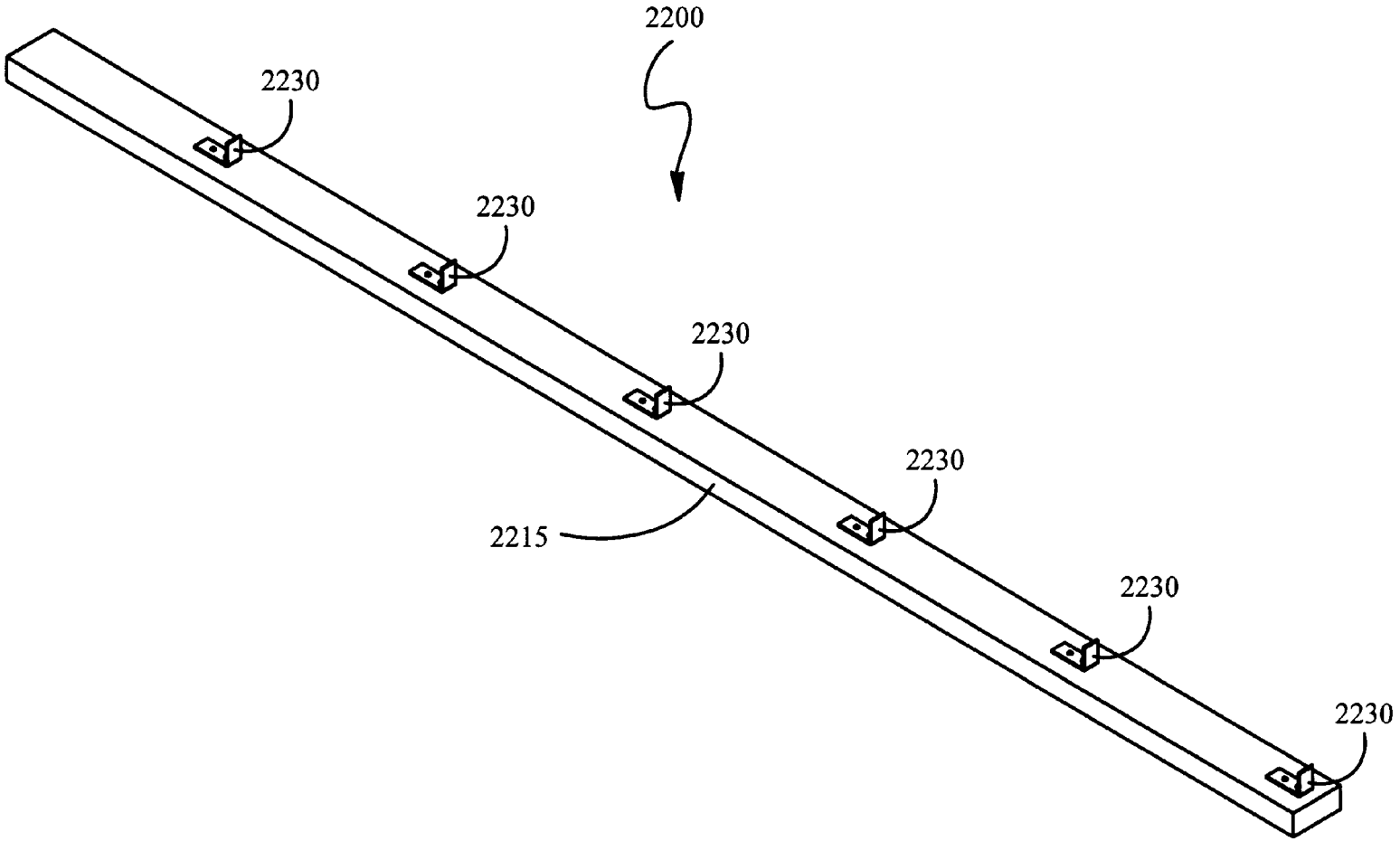
FIG. 22 is a perspective view of a corner base plate.
Figure 23:
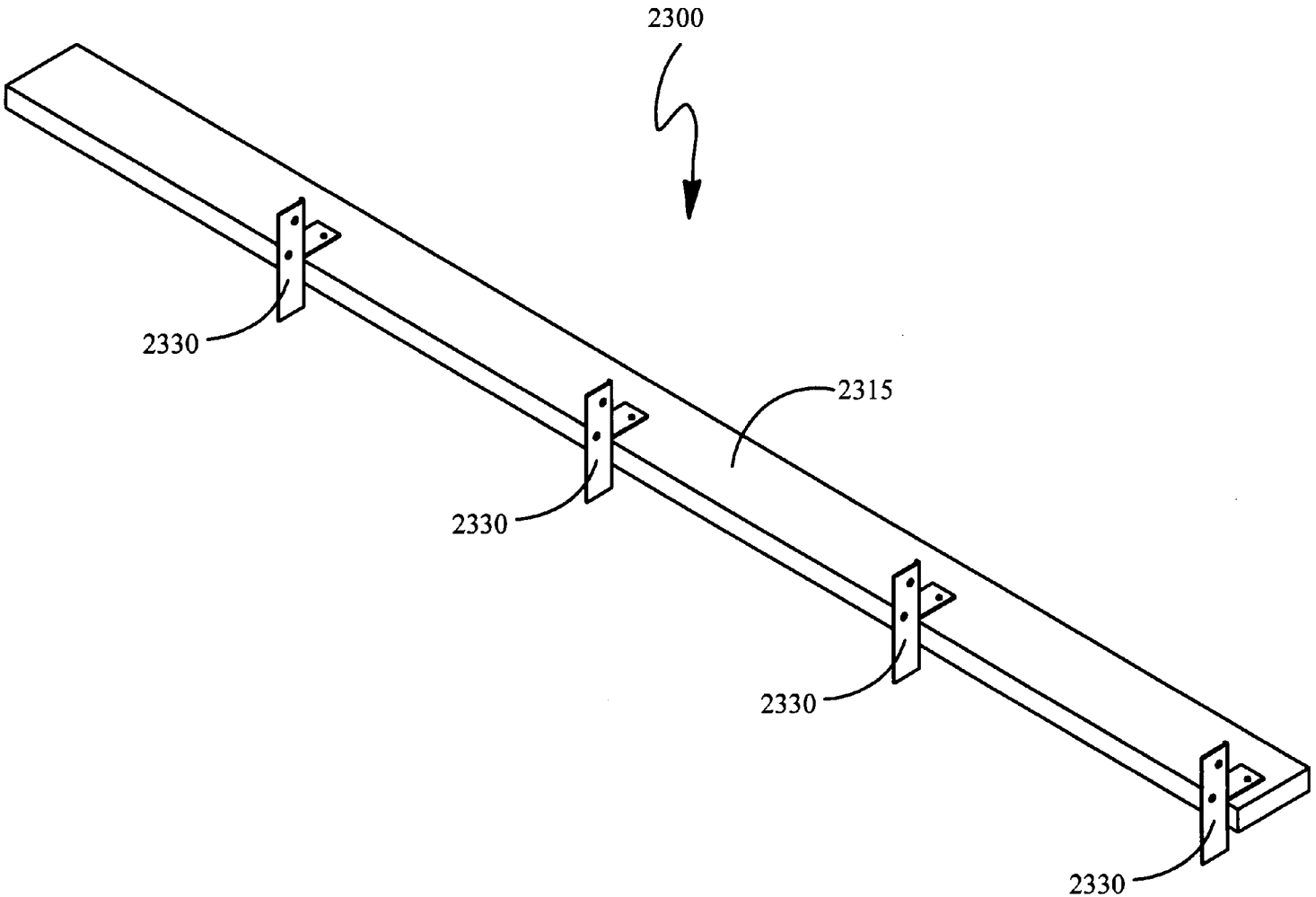
FIG. 23 is a perspective view of an anchor bracket base plate.
Figure 24:
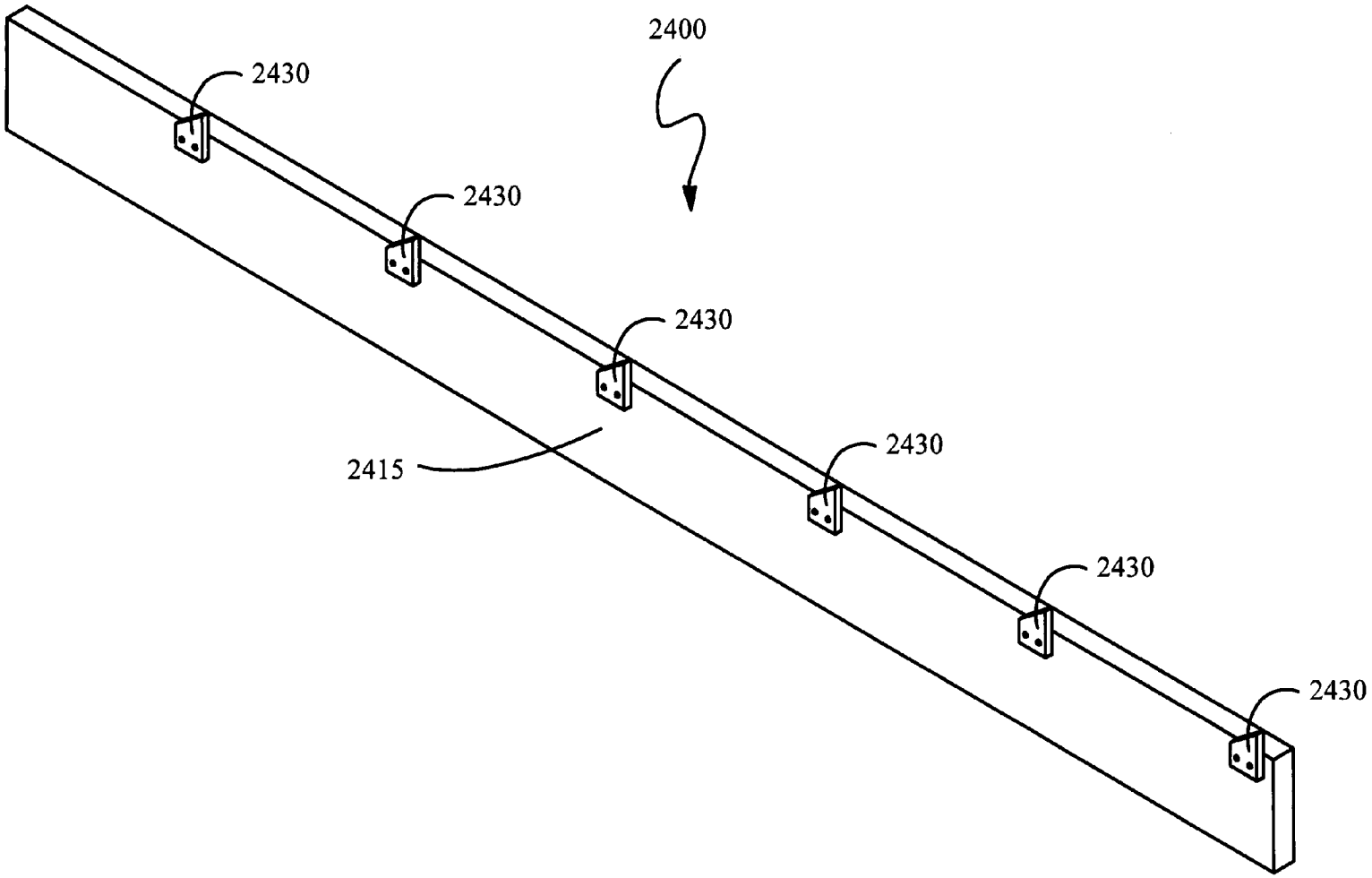
FIG. 24 is a perspective view of a silhouette base plate.
Figure 25:
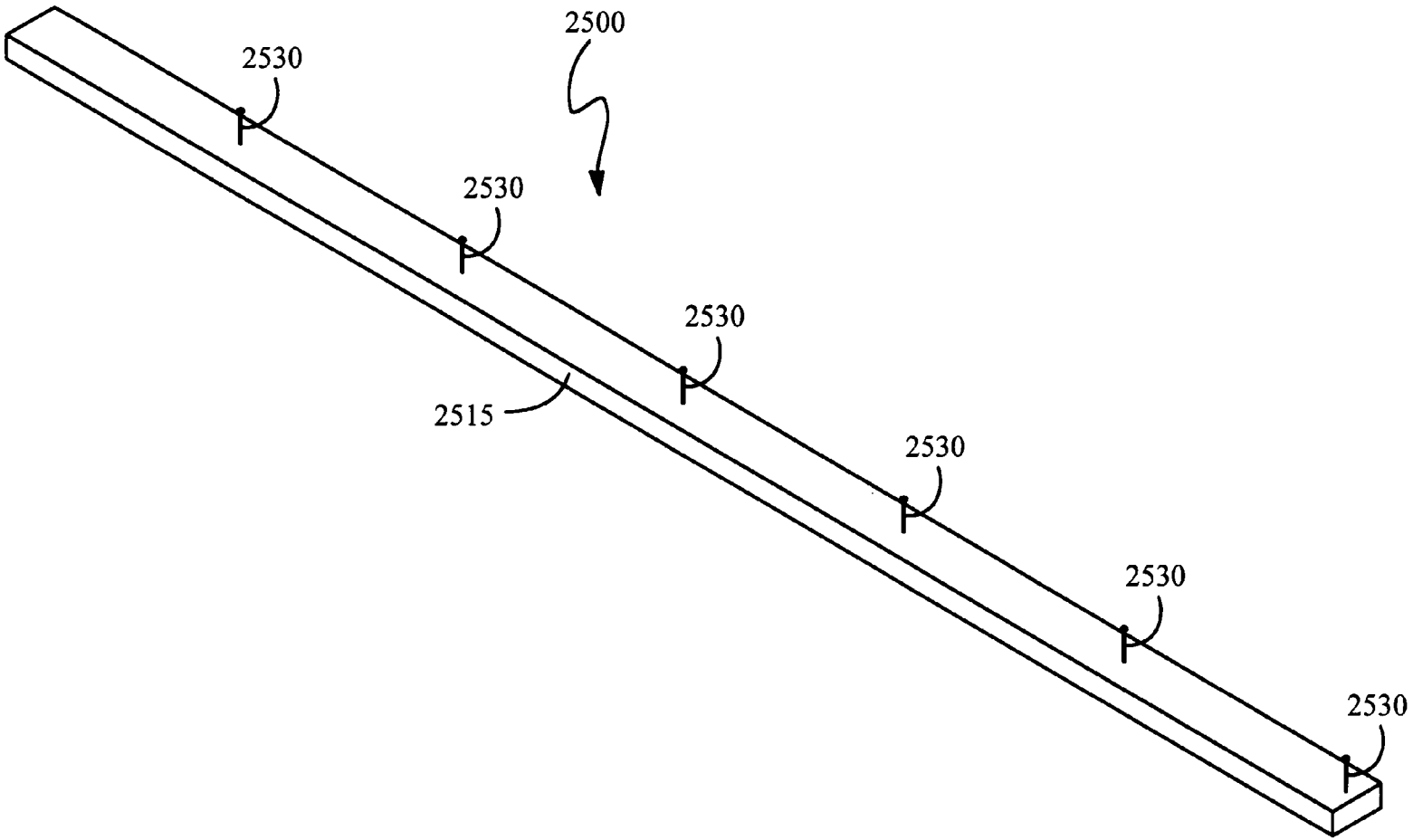
FIG. 25 is a perspective view of a nail base plate.
Figure 26:
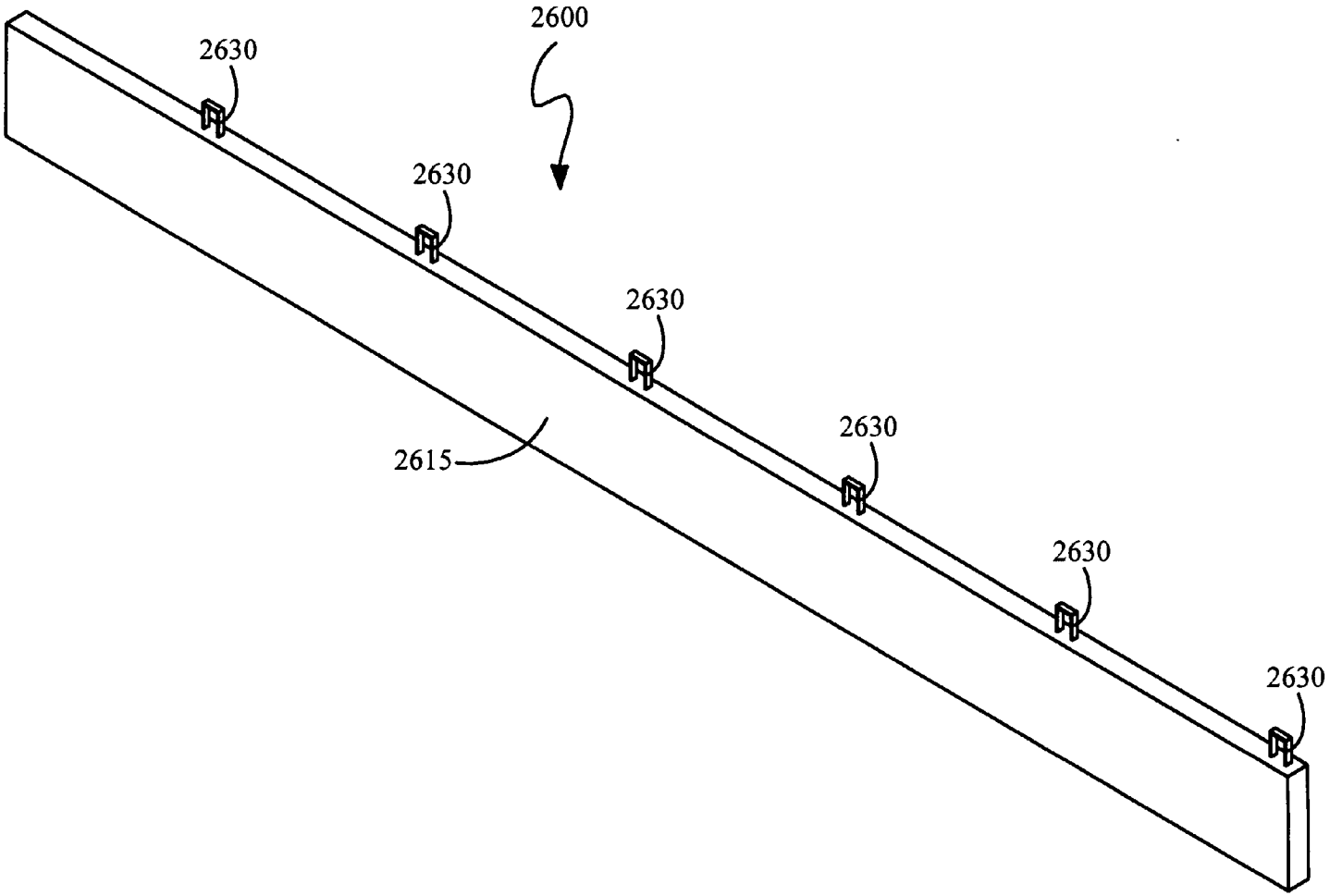
FIG. 26 is a perspective view of a staple base plate.

A base plate such as the base plate illustrated by way of FIG. 3 contains a plurality of hinge blocks 330. The hinge blocks may be varied, altered or modified in many ways, but still embrace the spirit and scope of the invention. FIGS. 21, 22, 23, 24, 25 and 26 illustrate various modifications to the base plate 300. In FIG. 21, a wood block base plate 2100 is shown. A base plate frame 2115 contains a plurality of wood block hinge blocks 2130. The wood block hinge blocks 2130 are fastened to the wood block base plate 2100 using nails, screws, bolts, glue, or the like. FIG. 22 shows a corner brace base plate 2200. The base plate frame 2215 contains a plurality of corner brace hinge blocks 2230 that are attached to the base plate frame 2215 with screws, nails, bolts, or the like. The corner brace hinge blocks 2230 are made of metal, plastic, fiberglass, or the like. FIG. 23 shows an anchor bracket base plate 2300. The base plate frame 2315 contains a plurality of anchor bracket hinge blocks 2330. The anchor bracket hinge blocks 2330 are made of metal, plastic, fiberglass, or the like. Anchor brackets may include, by way of example, and not limitation, hurricane anchors and seismic anchors. The anchor bracket hinge blocks are attached to the base plate frame 2315 with screws, nails, bolts, or the like. The anchor bracket hinge blocks 2330 also provide a means to anchor a truss to the top plate of a wall, providing wind bracing of the installed trusses. FIG. 24 shows a silhouette base plate 2400. The base plate frame 2415 contains a plurality of silhouette hinge blocks 2430. The silhouette hinge blocks 2430 are made of wood, plywood, metal, plastic, fiberglass, or the like. The silhouette hinge blocks 2430 are attached to the base plate frame 2415 with screws, nails, bolts, or the like. FIG. 25 shows a nail base plate 2500. The base plate frame 2515 contains a plurality of nail hinge blocks 2530. The nail hinge blocks 2530 are made of nails that are driven partially into the base plate frame 2515 at predetermined intervals. FIG. 26 shows a staple base plate 2600. The base plate frame 2615 contains a plurality of staple hinge blocks 2630. The staple hinge blocks 2630 are made of staples that are driven partially into the base plate frame 2615 at predetermined intervals. Other variations and types of hinge blocks may be attached to a base plate, as will be apparent to those skilled in the art.

Figure 27:
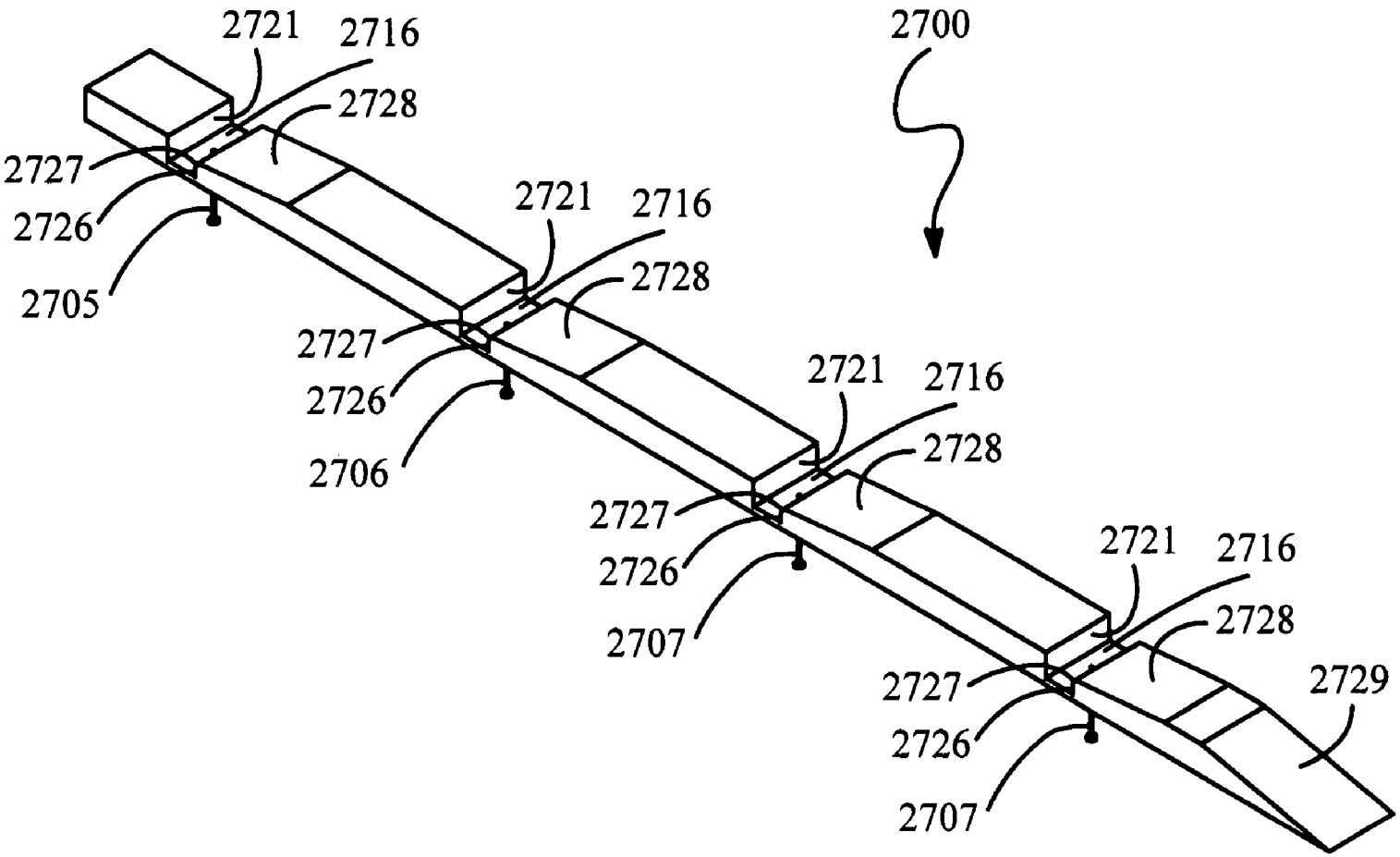
FIG. 27 is a perspective view of a one piece captor.

Referring now to FIG. 27, a perspective view of a one piece captor 2700 is shown. The one piece captor 2700 is similar in function to the captors described previously, but the one piece captor 2700 is cut from a single piece of material, such as framing lumber. The one piece captor 2700 contains a plurality of slots 2716 that serve to capture and retain a truss that is being set. In proximity to the slot 2716, a sliding plane 2728 is cut to guide a truss into the desired position. A stop face 2721 stops the travel of a truss (not shown) once the top chord of the truss enters the slot 2716. An orthogonal face 2726 prevents the truss from traveling in a backward direction. A bevel face 2727 may, in some embodiments, be in proximity to the slot 2716. To provide additional retention of a truss to the one piece captor 2700, a first fastener 2705, a second fastener 2706, and subsequent fasteners 2707 may be used. The fasteners may be nails, screws, bolts, rivets, or the like. In some embodiments, the one piece captor 2700 may contain a starter plane 2729 to allow the one piece captor to slide smoothly across the top chords of trusses being set. The various slots and cuts that are made to the one piece captor 2700 during manufacturing may be made with, for example, a table saw, a router, a router table, a dado blade mounted to a table saw, or the like.

Figure 28:
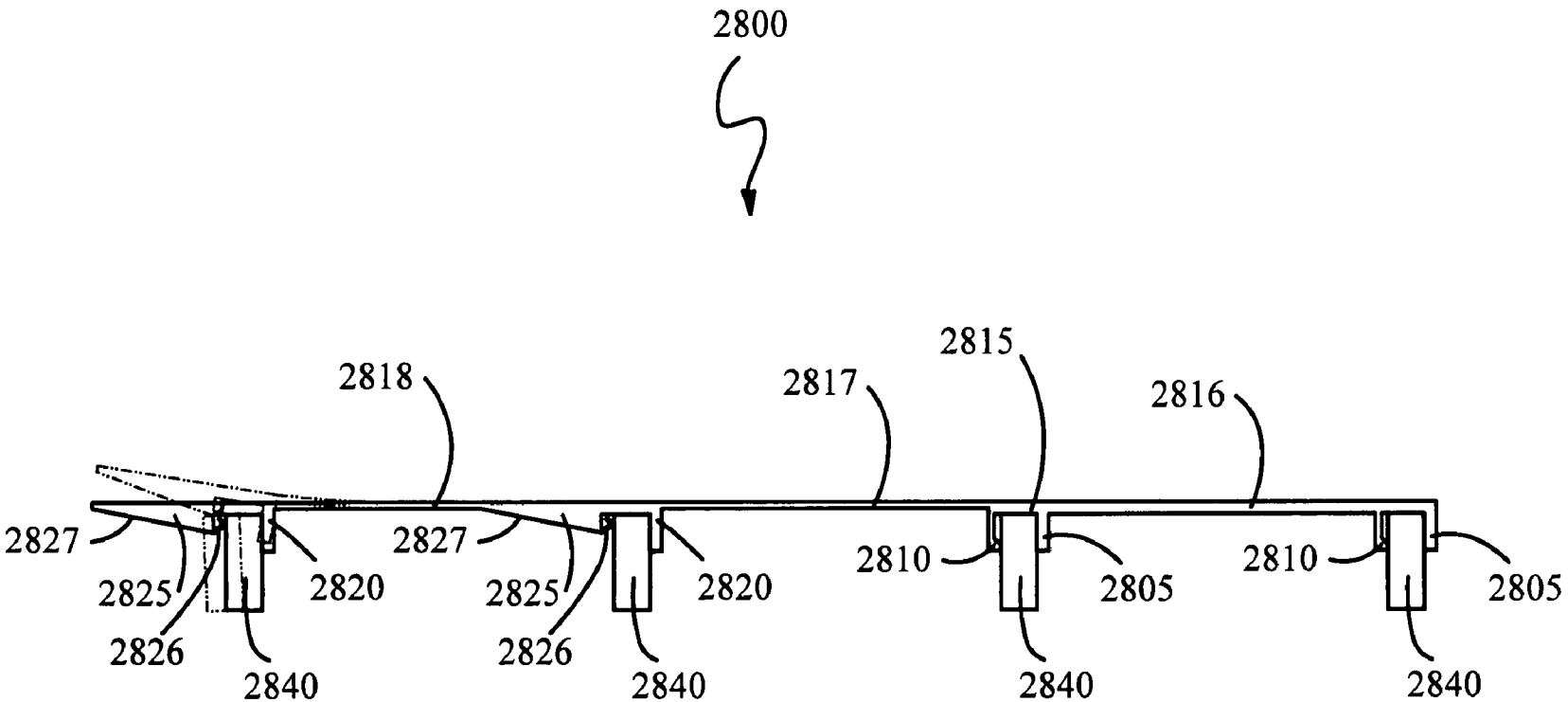
FIG. 28 illustrates the use of a one piece flexible captor to secure and retain a truss.

Referring now to FIG. 28, a one piece flexible captor 2800 is illustrated in use. The one piece flexible captor 2800 is another embodiment of the present invention. A one piece flexible captor 2800 may be made of a moderately flexible and durable material such as molded graphite, wood, lexan, polypropylene, polystyrene, acrylonitrile-butadiene-styrene, polycarbonate, nylon, polyethylene, polyethylene-terephthalate, acetal resin (such as Delrin™ from Dupont), acrylic, metal, fiberglass, or another plastic material. A mount block 2805 and a mount spring 2810 are attached to a captor frame mount section 2816. A one piece flexible captor frame 2815 serves as the primary structural element of the one piece flexible captor 2815. The one piece flexible captor frame 2815 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The mount block 2805 and the mount spring 2810 serve to retain a truss upper chord 2840. To provide additional stability to the one piece flexible captor 2800, in some embodiments an additional truss upper chord 2840 is retained by an additional mount block 2805 and mount spring 2810. A captor frame transition section 2817 connects a mount block 2805 and a mount spring 2810 to a stop block 2820. The stop block 2820 and a built in latch 2825 are spaced to accommodate the upper chord of a truss 2840. In use, as a truss is being set into position, the upper chord of a truss 2840 contacts the sliding face 2827, and raises one end of the one piece flexible captor 2800, as shown in FIG. 28. As the upper chord of the truss 2840 continues to travel along the sliding face 2827, a stop block 2820 will stop the travel of the truss 2840, allowing the upper chord of the truss 2840 to be captured, retained and secured between the stop block 2820 and the built in latch 2825. A latch spring face 2826 prevents backward travel of the truss 2840. Once the upper chord of the truss 2840 is captured between the stop block 2820 and the built in latch 2825, one end of the one piece flexible captor 2800 will travel downward, firmly securing the top chord of the truss 2840. In some embodiments, a captor frame transition section 2818 connects an additional stop block 2820 and built in latch 2825. An additional latch spring face 2826 and sliding face 2827 are also connected to the frame transition section 2818, as illustrated in FIG. 28. In other embodiments, additional stop blocks 2820, built in latches 2825, latch spring faces 2826 and sliding faces 2827 may be added to capture, retain and secure additional trusses.

Other embodiments of the invention may include variations on the latching mechanism used to capture, secure and retain a truss that is being erected. By way of example, and not limitation, FIGS. 29, 30 and 31 illustrate several latching mechanisms that may be used in various embodiments of the present invention.

Figure 29:
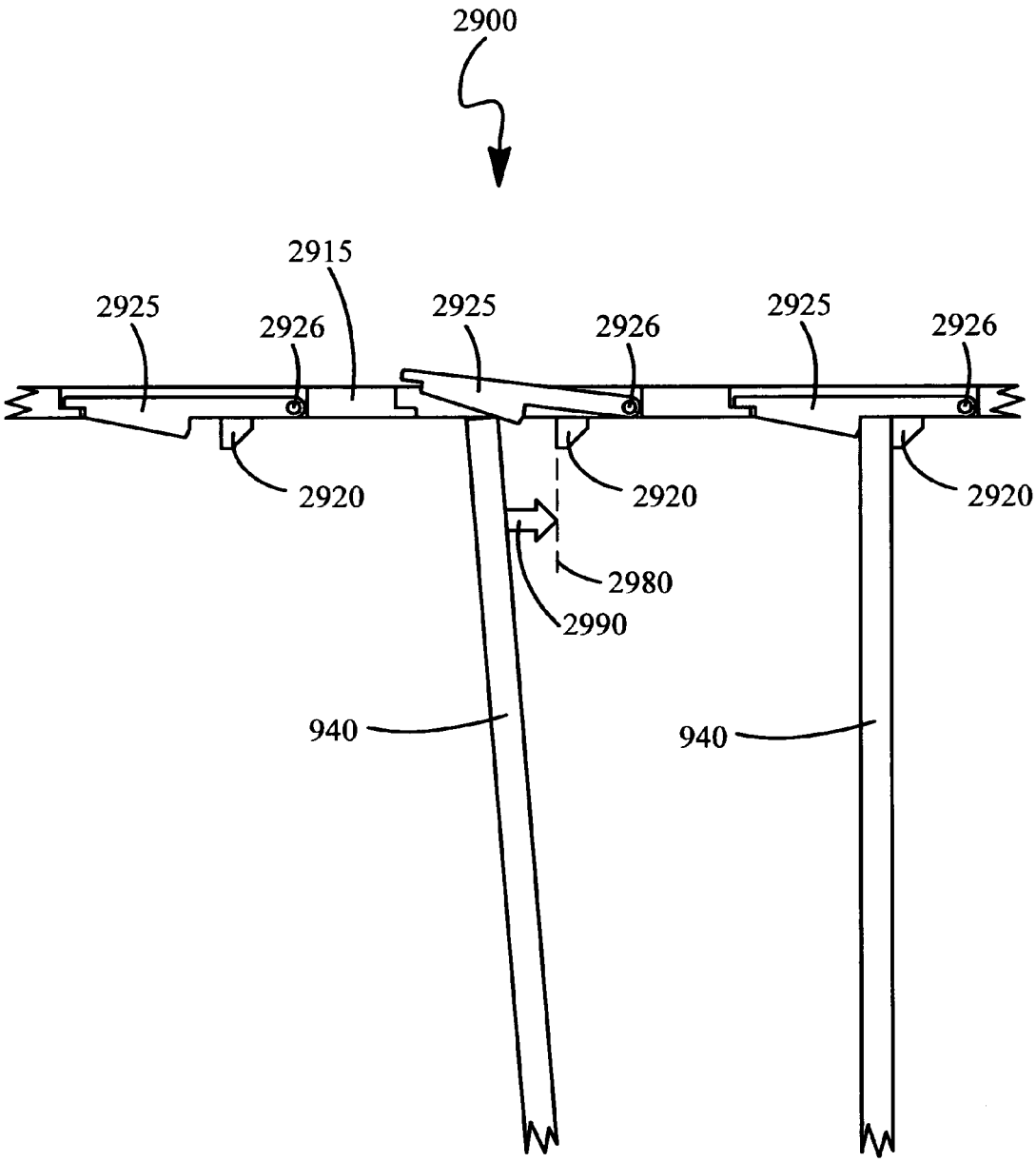
FIG. 29 illustrates the use of a swivel latch captor to secure and retain a truss.

Referring to FIG. 29, a swivel latch captor segment 2900 is shown. The stop blocks 2920 stop the travel 2990 of a truss 940 being erected. The travel of truss 940 is stopped along a stopping plane 2980. In FIG. 29, three groupings of stop block 2920, swivel latch 2925 and latch pivot 2926 are shown. The leftmost grouping illustrates the position of a stop block 2920, swivel latch 2925 and latch pivot 2926 before a truss is erected. The central grouping illustrates the position of a stop block 2920, swivel latch 2925 and latch pivot 2926 while a truss is erected. The rightmost grouping illustrates the position of a stop block 2920, swivel latch 2925 and latch pivot 2926 after a truss has been erected. A swivel latch 2925 is pivotally mounted to the captor frame segment 2915 with a latch pivot 2926. The captor frame 2915 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The swivel latch 2925 may, in some embodiments, be made of metal, plastic, fiberglass, wood, plywood, or the like. The latch pivot 2926 may, in some embodiments, be made of metal, plastic, wood, or the like. A spring (not shown) may, in some embodiments, be used to ensure proper positioning of said swivel latch 2925. In use, a truss 940 is erected. The top chord of the truss 940 contacts the swivel latch 2925, and causes the swivel latch 2925 to pivot upward. The truss 940, traveling in direction 2990, encounters the stop block 2920. The swivel latch 2925 is now free to travel downward, and captures and retains the truss 940.

Figure 30:
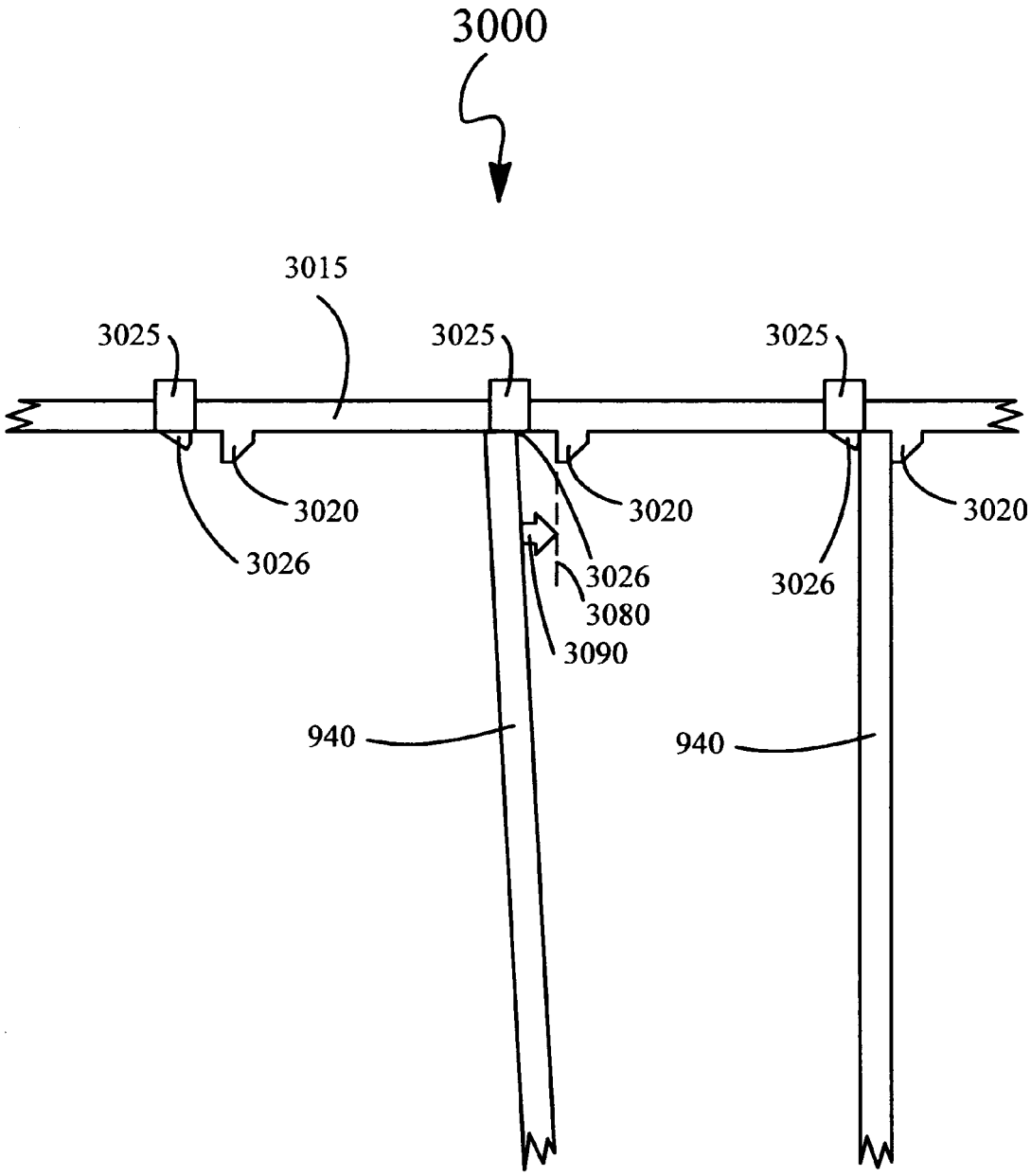
FIG. 30 illustrates the use of a sliding latch captor to secure and retain a truss.

Another embodiment of a latching mechanism of the present invention is illustrated by way of FIG. 30. FIG. 30 illustrates the use of a sliding latch captor segment 3000 to secure and retain a truss. The stop blocks 3020 stop the travel 3090 of a truss 940 being erected. The travel of truss 940 is stopped along a stopping plane 3080. In FIG. 30, three groupings of stop block 3020, sliding latch housing 3025 and slide latch 3026 are shown. The leftmost grouping illustrates the position of a stop block 3020, slide latch housing 3025 and slide latch 3026 before a truss is erected. The central grouping illustrates the position of a stop block 3020, slide latch housing 3025 and slide latch 3026 while a truss is erected. The rightmost grouping illustrates the position of a stop block 3020, slide latch housing 3025 and slide latch 3026 after a truss has been erected. A slide latch housing 3025 is mounted to the captor frame segment 3015 using bolts, screws, rivets, or the like. The captor frame segment 3015 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The slide latch housing 3025 and the slide latch 3026 may, in some embodiments, be made of metal, plastic, fiberglass, or the like. The slide latch 3026 is retained by the slide latch housing 3025, and travels along one axis. In some embodiments, the slide latch 3026 includes a spring (not shown). In use, a truss 940 is erected. The top chord of the truss 940 contacts the slide latch 3026, and causes the slide latch 3026 to travel upward. The truss 940, traveling in direction 3090, encounters the stop block 3020. The slide latch 3026 is now free to travel downward, and captures and retains the truss 940.

Figure 31:
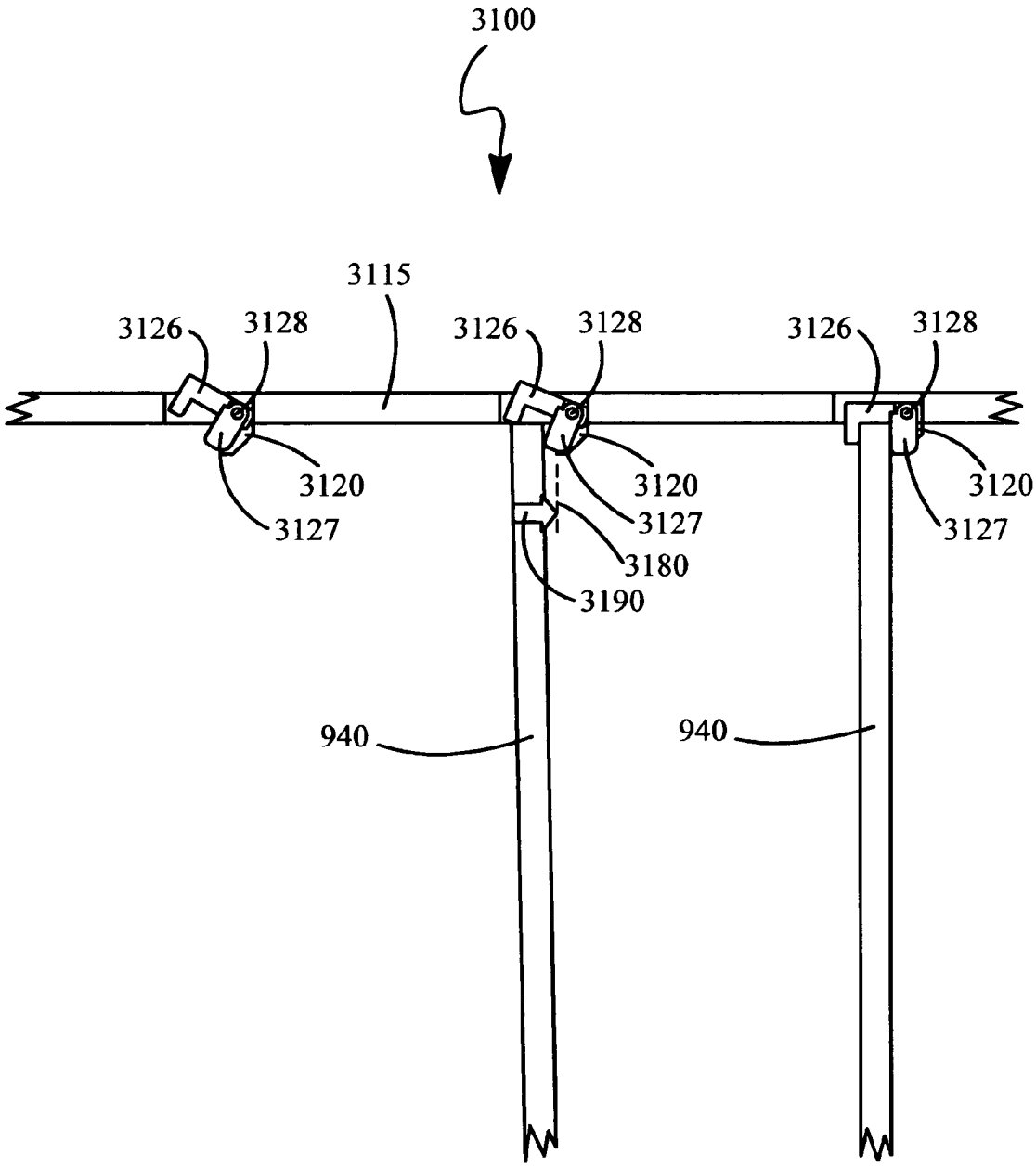
FIG. 31 illustrates the use of a positive latch captor to secure and retain a truss.

Another embodiment of a latching mechanism of the present invention is illustrated by way of FIG. 31. FIG. 31 illustrates the use of a positive latch captor segment 3100 to secure and retain a truss. The stop blocks 3120 stop the travel 3190 of a truss 940 being erected. The travel of truss 940 is stopped along a stopping plane 3180. In FIG. 31, three groupings of stop block 3120, positive latch 3126, latch actuator 3127 and latch pivot 3128 are shown. The leftmost grouping illustrates the position of a stop block 3120, positive latch 3126, latch actuator 3127 and latch pivot 3128 before a truss is erected. The central grouping illustrates the position of a stop block 3120, positive latch 3126, latch actuator 3127 and latch pivot 3128 while a truss is erected. The rightmost grouping illustrates the position of a stop block 3120, positive latch 3126, latch actuator 3127 and latch pivot 3128 after a truss has been erected. The positive latch 3126 and the latch actuator 3127 are pivotally mounted to the captor frame segment 3115 using a latch pivot 3128. The captor frame segment 3115 is an elongate member that spans the distance between at least two trusses. The distance between two trusses may vary based on building and structural design requirements. Examples of truss spacing distances that are commonly used include, but are not limited to, 16 inches on center, 2 feet on center, 4 feet on center, and the like. The latch pivot 3128 may, in some embodiments, be a pin. The latch pivot 3128 may, in some embodiments, contain a spring (not shown). The positive latch 3126 and the latch actuator 3127 may, in some embodiments, be made of metal, plastic, fiberglass, or the like. In use, when a truss 940 is erected, the top chord of the truss 940 contacts the latch actuator 3127, which in turn causes the positive latch 3126 to travel upward. The truss 940, traveling in direction 3190, encounters the stop block 3120. The positive latch 3126 is now free to travel downward, and captures and retains the truss 940.

Modifications and variations to the various embodiments of the present invention will be apparent to those skilled in the art. By way of example, and not limitation, the latches and stop block pairs used in the various embodiments of the present invention may, in some embodiments, be adjustable to accommodate varying truss center to center spacing. This may prove useful when, for example, a captor is repetitively used for different building projects, and the different building projects specify varying truss center to center spacing such as 16 inches on center, 16 inches on center, 2 feet on center, 4 feet on center, and the like. Other adjustments to the latches and stop block pairs may include fine positioning adjustment with crank and screw adjusters to compensate for errors made during building construction, such as out of plumb or out of square conditions. Other variations may include the addition of temporary hinge blocks to a base plate, the addition of additional captors during the erection of trusses, or the use of a captor mounted to a truss that is being set to engage a truss that is in place.

It is, therefore, apparent that there has been provided, in accordance with the various objects of the present invention, an apparatus for stabilizing and spacing prefabricated trusses during the construction of a building. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for stabilizing and spacing a second truss to a first truss, wherein each of said first truss and said second truss comprises a top chord and a bottom chord, and wherein said apparatus comprises:

a frame for spanning the top chords of said trusses;

a stop block attached to said frame; and a substantially triangularly shaped wedge latch attached to said frame, wherein the substantially triangularly shaped wedge latch has a gliding surface along it's hypotenuse that allows for travel of the top chord of a truss along the hypotenuse of said wedge latch during placement and erection of a truss, and further wherein the height of the stop block in relation to the frame is greater than the height of the wedge latch in relation to the frame.

2. The apparatus as recited in claim 1, further comprising a mount end plate attached to one end of said frame, and a mount support brace further attached to said frame at a point offset from said mount support brace by a distance at least equal to the thickness of the top chord of said trusses.

3. The apparatus as recited in claim 1, further comprising a brace and a clamp attached to said frame.

4. The apparatus as recited in claim 1, wherein said stop block is resilient.

5. The apparatus as recited in claim 1, wherein said wedge latch is resilient.

6. The apparatus as recited in claim 1, further comprising an attachment means for attaching said apparatus to said trusses.

7. The apparatus as recited in claim 1, further comprising a squaring mechanism.

8. The apparatus as recited in claim 1, further comprising a mount hook.

9. The apparatus as recited in claim 1, further comprising a plurality of fasteners.

10. The apparatus as recited in claim 1, further comprising two mount blocks attached to said frame.

11. The apparatus as recited in claim 1, wherein said frame is hinged.

12. The apparatus as recited in claim 1, wherein said frame is flexible.

13. The apparatus as recited in claim 1, wherein said frame is rigid.

14. The apparatus as recited in claim 1, wherein said frame further comprises a starter plane.

15. The apparatus as recited in claim 1, wherein said stop block and said wedge latch are made from a single piece of material.

16. The apparatus as recited in claim 1, wherein said stop block and said wedge latch are a silhouette form.

17. The apparatus as recited in claim 1, wherein said stop block is a stop face and said wedge latch is an orthogonal face.

18. The apparatus as recited in claim 1, wherein said wedge latch is pivotal.

19. The apparatus as recited in claim 1, wherein said wedge latch slides.

20. The apparatus as recited in claim 1, wherein said wedge latch contains a latch actuator.

21. The apparatus as recited in claim 1, further comprising a plurality of hinge blocks attached to a base plate frame, wherein said base plate frame is mounted to a support and said hinge blocks engage the bottom chord of said truss.

22. The apparatus as recited in claim 21, wherein said hinge blocks are removable.

23. The apparatus as recited in claim 21, wherein said hinge blocks are anchors.

24. The apparatus as recited in claim 21, wherein said hinge blocks are nails.

25. The apparatus as recited in claim 21, wherein said hinge blocks are a silhouette form.

26. The apparatus as recited in claim 21, wherein said hinge blocks are blocks.

* * * * *